US005380613A

United States Patent [19]

Ueda et al.

[11] Patent Number: 5,380,613

[45] Date of Patent: Jan. 10, 1995

[54] PHOTOSENSITIVE MEMBER COMPRISING ELECTRONATTRACTING COMPOUND AND HINDERED PHENOL COMPOUND

[75] Inventors: Hideaki Ueda, Kawanishi; Shigeaki Tokutake, Takatsuki; Keiichi Inagaki, Itami; Yuki Shimada, Suita, all of Japan

[73] Assignee: Minolta Camera Kabushiki Kaisha, Osaka, Japan

[21] Appl. No.: 926,291

[22] Filed: Aug. 10, 1992

[30] Foreign Application Priority Data

| | | | |
|---|---|---|---|
| Aug. 13, 1991 | [JP] | Japan | 3-202737 |
| Aug. 13, 1991 | [JP] | Japan | 3-202740 |
| Aug. 13, 1991 | [JP] | Japan | 3-202744 |
| Aug. 13, 1991 | [JP] | Japan | 3-202746 |
| Aug. 13, 1991 | [JP] | Japan | 3-202748 |
| Feb. 7, 1992 | [JP] | Japan | 4-022443 |

[51] Int. Cl.[6] ..... G03G 15/02

[52] U.S. Cl. ..... 430/58; 430/59; 430/60

[58] Field of Search ..... 430/58, 59, 60

[56] References Cited

U.S. PATENT DOCUMENTS

| | | | |
|---|---|---|---|
| 4,407,919 | 10/1983 | Murayama et al. | 430/58 |
| 4,480,020 | 10/1984 | Kondo et al. | 430/81 |
| 4,599,286 | 7/1986 | Limburg et al. | 430/59 |
| 4,932,860 | 6/1990 | Yoshihara et al. | 430/83 |

FOREIGN PATENT DOCUMENTS 58-54346 3/1983 Japan .

*Primary Examiner*—Steve Rosasco

*Attorney, Agent, or Firm*—Burns, Doane, Swecker & Mathis

[57] ABSTRACT

The present invention relates to a photosensitive member comprising a charge generating material, a charge transporting material, a binder resin and a specified electronattracting material, preferably further specified hindered phenol compound.

16 Claims, 1 Drawing Sheet

PHOTOSENSITIVE MEMBER COMPRISING ELECTRONATTRACTING COMPOUND AND HINDERED PHENOL COMPOUND

BACKGROUND OF THE INVENTION

In electrophotography, copied images are formed by various kinds of methods. For example, the surface of a photosensitive member is electrically charged and irradiated to form electrostatic latent images thereon, the electrostatic latent images are developed by a developer to be made visible and then the developed electrostatic latent images are fixed directly onto the photosensitive member (referred to as a direct method). In other method, developed electrostatic latent images on a photosensitive member which are made visible by a developer are transferred to copy paper and then, the transferred images are fixed on the paper (referred to as a powder transferring method). In another method, electrostatic latent images on a photosensitive member are transferred onto copy paper, the transferred electrostatic latent images are developed by a developer and then fixed on the copy paper (referred to as an electrostatic latent image transferring method).

Conventionally known photosensitive materials for forming a photosensitive member include inorganic photoconductive materials such as selenium, cadmium sulfide or zinc oxide.

These photoconductive materials have many advantages such as chargeability to an adequate potential level in the dark, low loss of charges in the dark, an electrical charge which can be rapidly dissipated with irradiation of light and the like. However, they have disadvantages. For example, a photosensitive member based on selenium is difficult to produce, has high production costs and is difficult to handle due to inadequate resistivity to heat or mechanical impact. A photosensitive member based on cadmium sulfide has defects such as its unstable sensitivity in a highly humid environment and loss of stability with the time because of the deterioration of dyestuffs, added as a sensitizer, by corona charge and fading with exposure.

Many kinds of organic photoconductive materials such as polyvinylcarbazole and so on have been proposed. These organic photoconductive materials have superior film forming properties, are light in weight, etc., but inferior in sensitivity, durability and environmental stability compared to the aforementioned inorganic photoconductive materials.

Various studies and developments have been in progress to overcome the above noted defects and problems. A function-divided photosensitive member has been proposed, in which charge generating function and charge transporting function are divided to form a photosensitive layer on an electrically conductive substrate (for example aluminum). Such function-divided photosensitive members have high productivity and low costs since they can be prepared by coating, and suitably selected charge generating materials can freely control a region of photosensitive wavelength.

However, when a photosensitive member above mentioned is used repeatedly, there arise such problems as decrease of initial surface potential, gradual increase of residual potential and formation of fogs in copy images. These problems may be brought about by interface conditions between a charge generating material and a binder resin or charge transporting material and binder resin, energy barrier, impurities, corona-discharge, image-irradiation, deterioration of materials caused by irase-lamp, adsorption of oxidizing gas such as ozone, NOx etc., deterioration of materials caused thereby. Therefore, many trapping positions generate in a photosensitive layer.

Generated charges may be caught at the trapping positions before encountering surface charges.

In order to prevent the increase of residual potential etc., there are proposed many techniques such as removal of impurities from materials, prevention of composition from deterioration by addition of antioxidant (for example Japanese Patent Laid-Open Sho 57-122444), addition of electronattracting compounds (for example Japanese Patent Laid-Open Sho 58-7643, Japanese Patent Laid-Open Sho 58-54346). However, the fact is that a photosensitive member excellent in long repetition can not be obtained.

Further, higher reliability on copy images and repetition stability are required than before because a photosensitive member is also applied to a laser-printer.

SUMMARY OF THE INVENTION

It is an object of the present invention to provide a photosensitive member excellent in sensitivity and durability, and improved in decrease of surface potential and increase of residual potential.

The present invention relates to a photosensitive member comprising a charge generating material, a charge transporting material, a binder resin and a specified electronattracting material, preferably further specified hindered phenol compound.

DETAILED DESCRIPTION OF THE INVENTION

Figure 1:
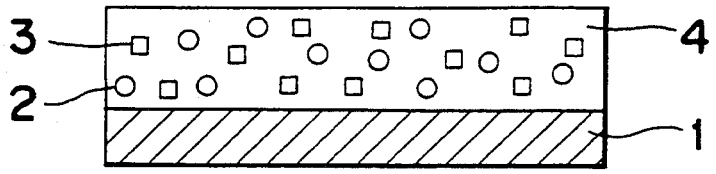
FIG. 1 is a diagram showing the structure of a dispersion-type photosensitive member embodying the invention comprising a photosensitive layer formed on an electrically conductive substrate.

The present invention can be achieved by containing a specified electronattracting material or a specified hindered phenol compound in combination with a specified electronattracting material.

First, the present invention provides a photosensitive member composed of a photosensitive layer on an electrically conductive substrate characterized by that the photosensitive layer comprises a charge generating material, a charge transporting material, a binder resin and an electronattracting compound represented by the following general formulas [I]–IV]:

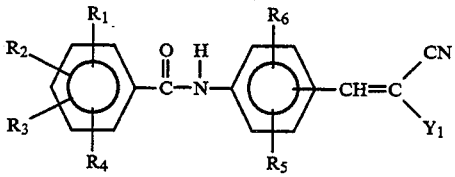

[I]

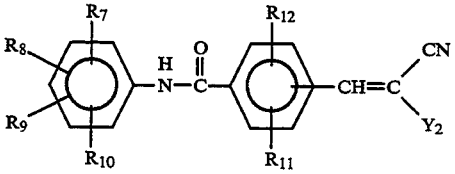

[II]

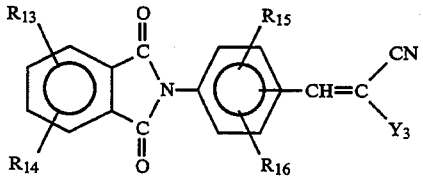

[III]

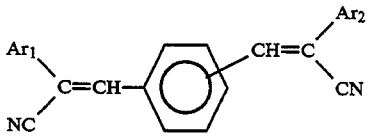

[IV]

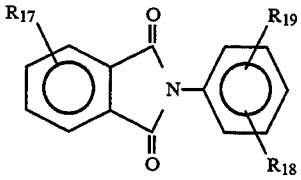

[V]

When the electronattracting compound represented by the above general formulas [I]–IV] is added, the decrease of initial surface potential caused by repetition use and the increase of residual potential can be prevented.

in the general formula [I]–IV], $Y_1$, $Y_2$ and $Y_3$ represent respectively a cyano group, an alkoxycarbonyl group such as methoxycarbonyl and ethoxycarbonyl, aryloxycarbonyl group (such as phenyloxycarbonyl) which may have a substituent or an aryl group such as phenyl or naphthyl which may have a substituent. Preferable substituents are cyano group or a nitro group.

$R_1$–$R_{16}$ represent respectively a hydrogen atom, a halogen atom, an alkyl group such as methyl, ethyl and propyl, an alkoxy group (such a methoxy, ethoxy and propoxy), a nitro group, a cyano group, a benzoyl group which may have a substituent, an aryloxycarbonyl group (such as phenyloxycarbonyl) which may have a substituent, an aryloxycarbonyl group (such as phenyloxycarbonyl) which may have a substituent, an alkoxycarbonyl (such as methoxycarbonyl, ethoxycarbonyl) or

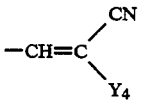

in which $Y_4$ represents a cyano group, an alkoxycarbonyl group such as methoxycarbonyl and ethoxycarbonyl, an aryloxycarbonyl group such as phenyloxycarbonyl which may have a substituent, or an aryl group (such as phenyl and naphthyl) which may have a substituent. As the substituent, an attracting group such as cyano or naphthyl is preferable.

An electronattracting compound of the formula [I] is exemplified by the following ones:

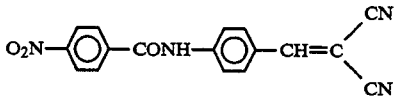

[I-1]

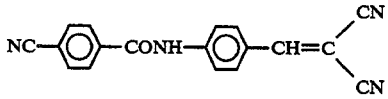

[I-2]

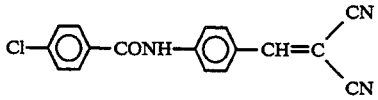

[I-3]

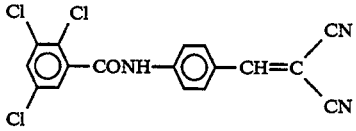

[I-4]

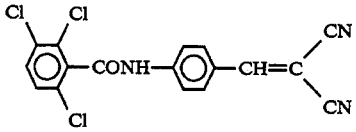

[I-5]

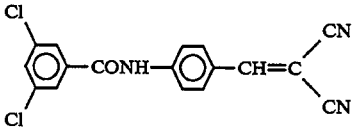

[I-6]

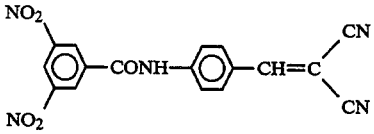

[I-7]

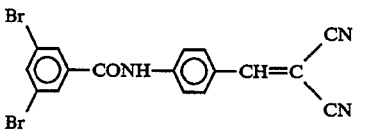

[I-8]

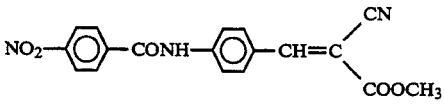

[I-9]

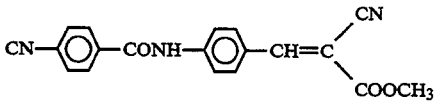

[I-10]

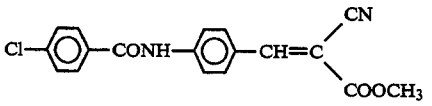

[I-11]

-continued

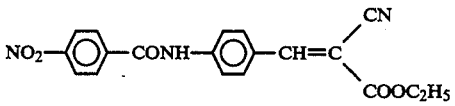
[I-12]

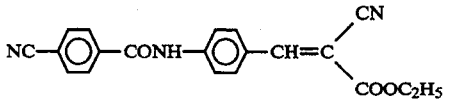
[I-13]

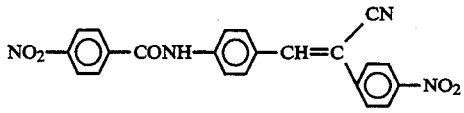
[I-14]

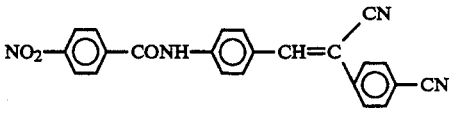
[I-15]

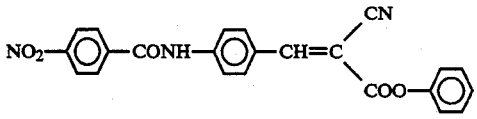
[I-16]

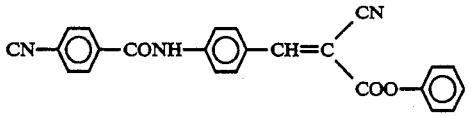
[I-17]

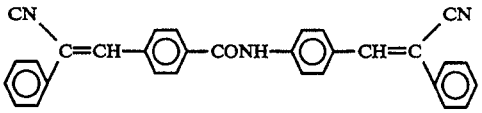
[I-18]

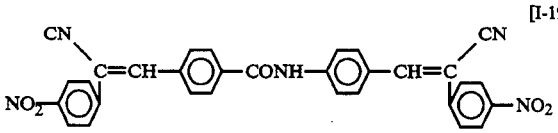
[I-19]

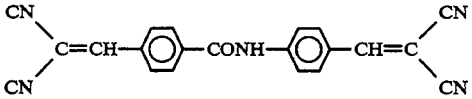
[I-20]

Preferable ones among those above are [I-2], [I-3], [I-4], [I-5], [I-9], [I-12], [I-14], [I-15] and [I-19].

An electronattracting compound represented by the general formula [I] can be prepared easily as follows;

The compounds represented by the following formula:

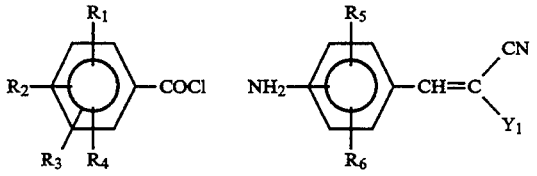

in which $R_1$–$R_6$ and $Y_1$ are the same as in the Formula [I] are treated for condensation in the presence of a basic catalyst such as pyridine in a solvent such as toluene and chlorobenzene.

An electronattracting compound of the formula [II] is exemplified by the following ones:

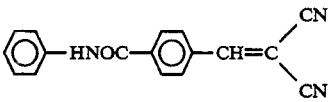
[II-1]

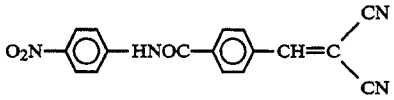
[II-2]

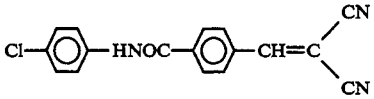
[II-3]

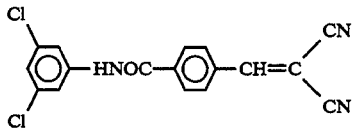
[II-4]

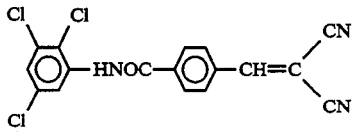
[II-5]

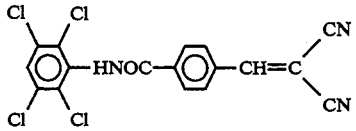
[II-6]

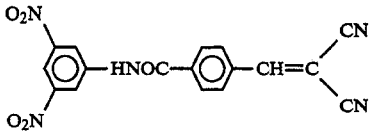
[II-7]

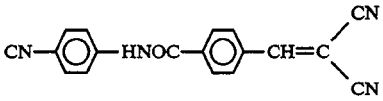
[II-8]

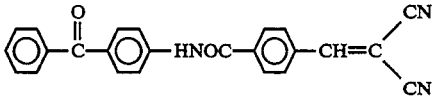
[II-9]

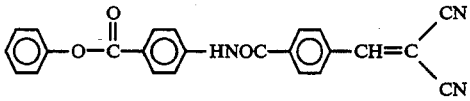
[II-10]

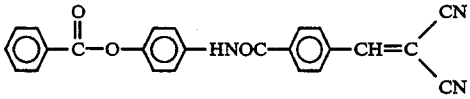
[II-11]

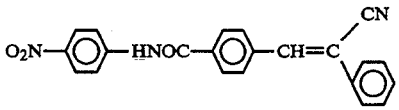
[II-12]

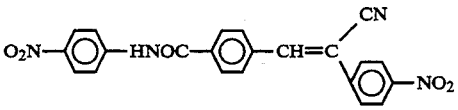
[II-13]

-continued

[II-14]

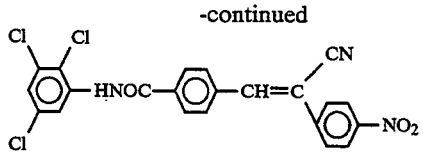

[II-15]

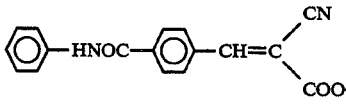

[II-16]

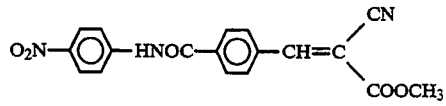

[II-17]

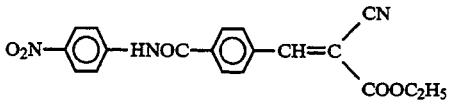

[II-18]

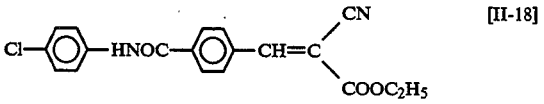

[II-19]

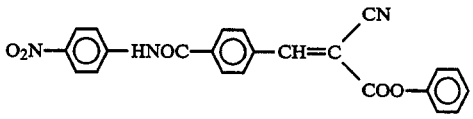

-continued

[II-20]

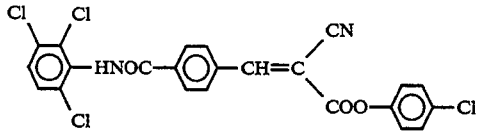

Preferable ones among those above are [II-2], [II-3[, [II-4], [II-5], [II-8], [II-10], [II-11], [II-14] and [II-17].

An electronattracting compound represented by the general formula [II] can be prepared easily as follows;

The compounds represented by the following formula:

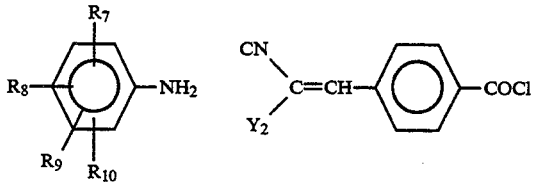

in which $R_7$–$R_{10}$ and $Y_2$ are the same as in the formula [II] are treated for condensation in the presence of a basic catalyst such as pyridine in a solvent such as toluene and chlorobenzene.

An electronattracting compound of the formula [III] is exemplified by the following ones:

[III-1]

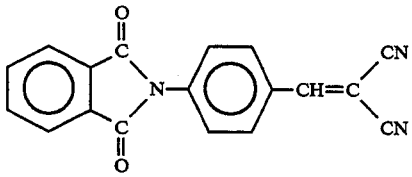

[III-2]

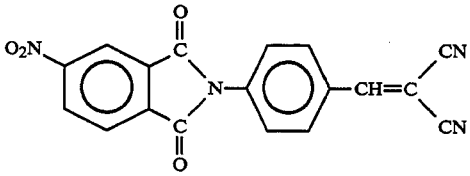

[III-3]

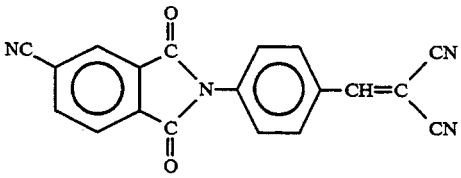

[III-4]

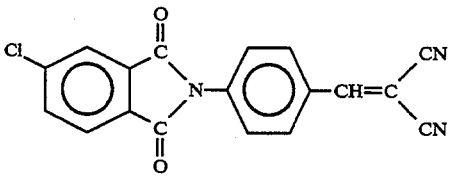

[III-5]

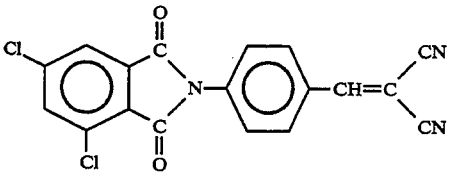

-continued
[III-6]
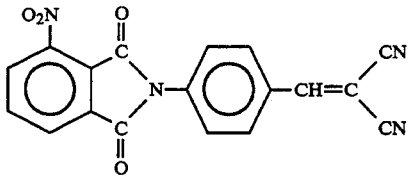
[III-7]
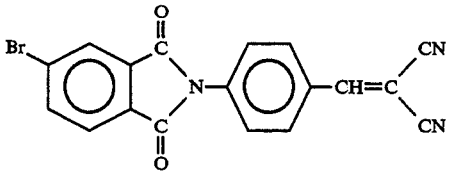
[III-8]
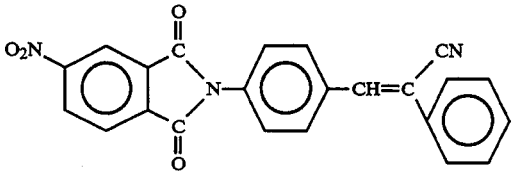
[III-9]
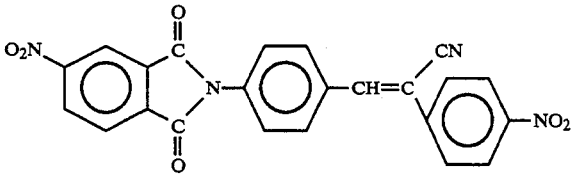
[III-10]
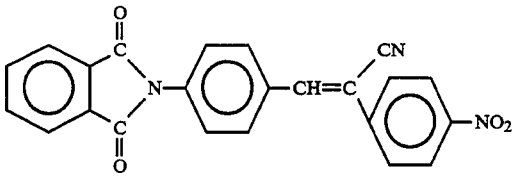
[III-11]
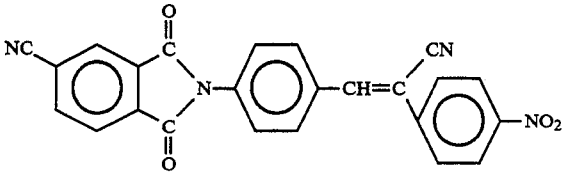
[III-12]
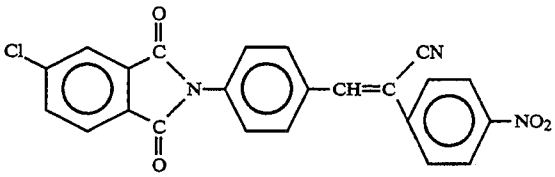
[III-13]
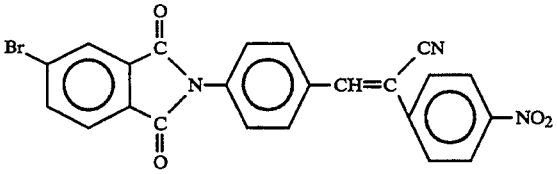
[III-14]
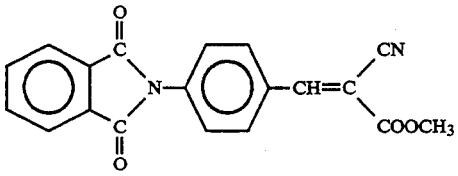

-continued

[III-15]

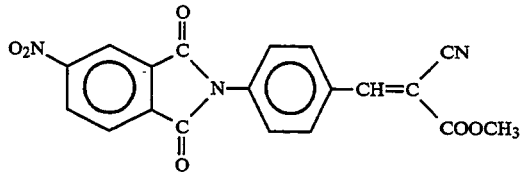

[III-16]

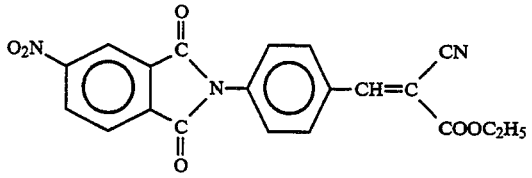

[III-17]

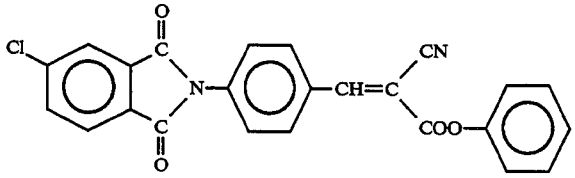

[III-18]

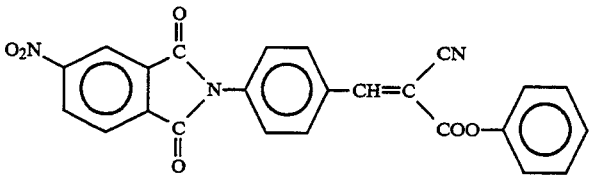

[III-19]

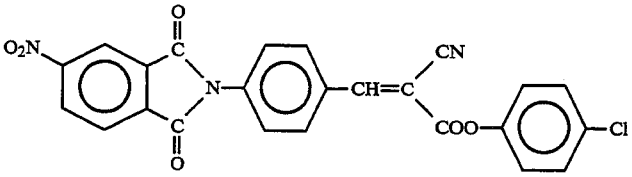

[III-20]

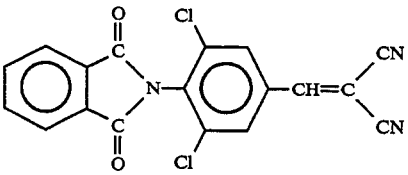

Preferable ones among those above are [III-2], [III-3], [III-4], [III-7], [III-9], [III-10], [III-12], [III-15] and [III-16], and [III-18].

An electronattracting compound represented by the general formula [III] can be prepared easily as follows;

The compounds represented by the following formula:

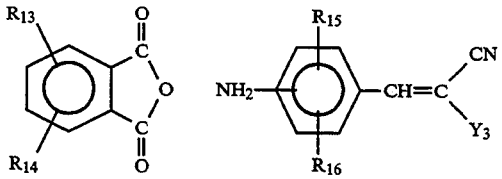

in which $R_{13}$–$R_{16}$ and $Y_3$ are the same as in the formula [III] are treated for condensation in the presence of acetic anhydride (catalyst) in dimethylformamide (solvent).

In the general formula [IV], $Ar_1$ and $Ar_2$ represent respectively a cyano group, an aryl group (such a phenyl and naphthyl) which may have a substituent, an alkoxycarbonyl group (such as methoxycarbonyl, ethoxycarbonyl and benzyloxycarbonyl), an acyl group such as methylcarbonyl, ethylcarbonyl, propylcarbonyl and butylcarbonyl, and aminocarbonyl group (such as methylaminocarbonyl), a halogen atom (fluorine, chlorine and bromine, an alkyl group (such as methyl and ethyl) or a benzoyl group which may have a substituent.

Preferable $Ar_1$ and $Ar_2$ are the ones having stronger electronattracting properties such as a cyano group and an alkoxycarbonyl group.

The substituent which may be bound to the aryl group or the benzoyl group is exemplified by a nitro group, a halogen atom (chlorine, bromine etc.) or a cyano group. A nitro group or a cyano group is preferable because of strong electronattracting properties.

An electronattracting compound of the formula [IV] is exemplified by the following ones:

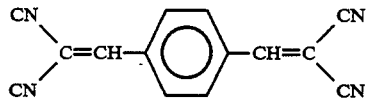
[IV-1]
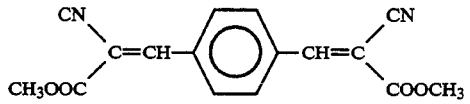
[IV-2]
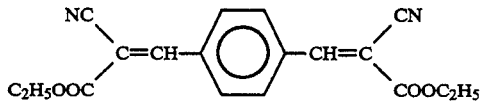
[IV-3]
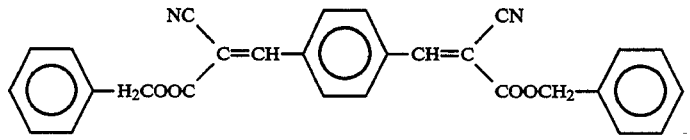
[IV-4]
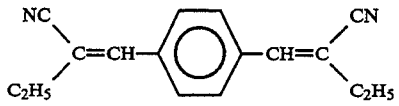
[IV-5]
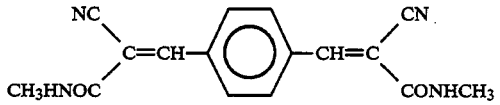
[IV-6]
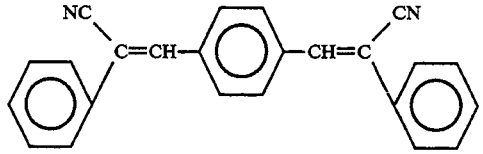
[IV-7]
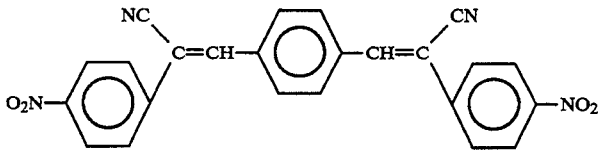
[IV-8]
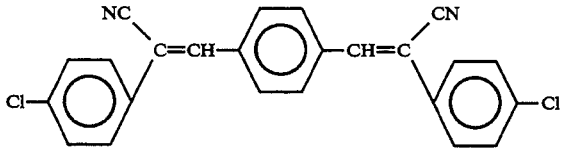
[IV-9]
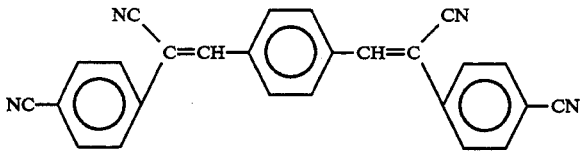
[IV-10]
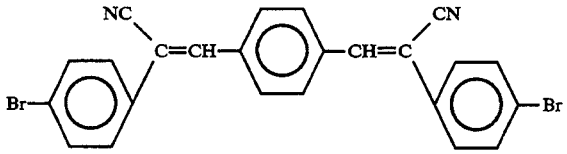
[IV-11]

-continued
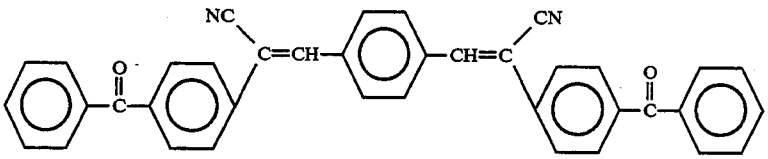
[IV-12]
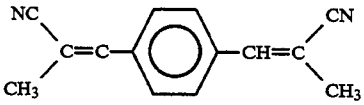
[IV-13]
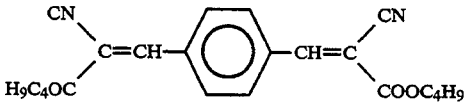
[IV-14]
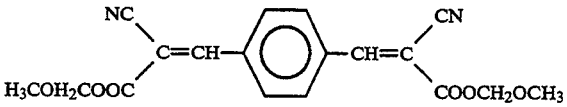
[IV-15]
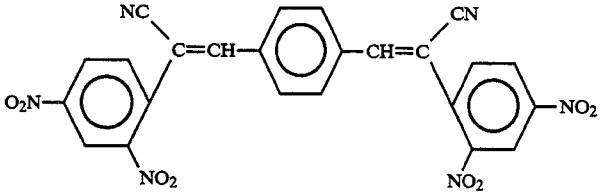
[IV-16]
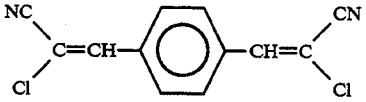
[IV-17]
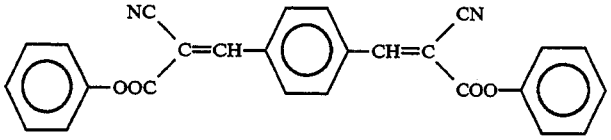
[IV-18]
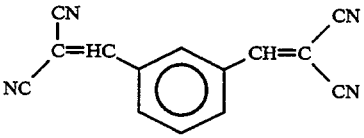
[IV-19]
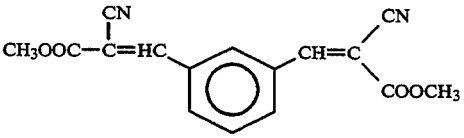
[IV-20]
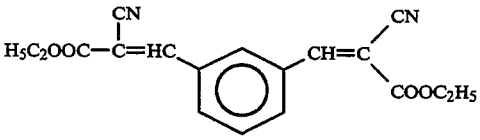
[IV-21]
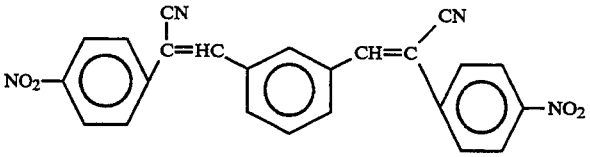
[IV-22]

-continued
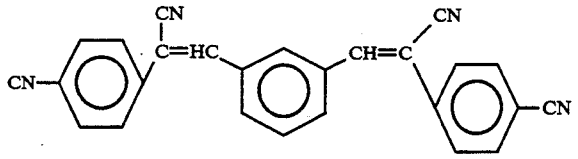
[IV-23]
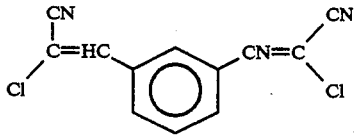
[IV-24]
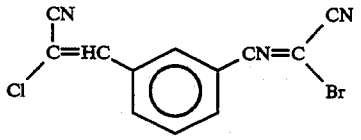
[IV-25]
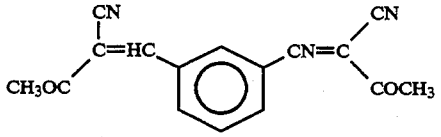
[IV-26]
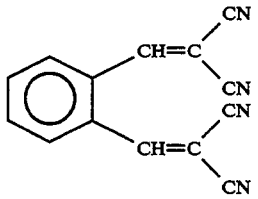
[IV-27]
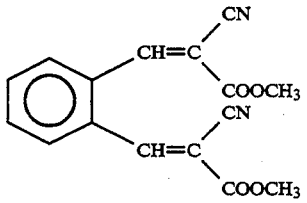
[IV-28]
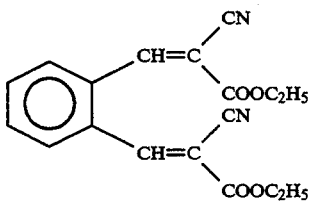
[IV-29]
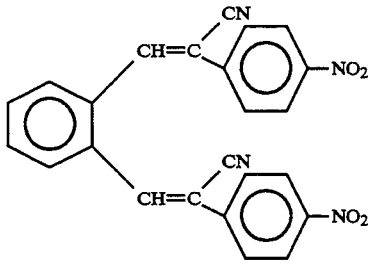
[IV-30]

-continued

[IV-31]

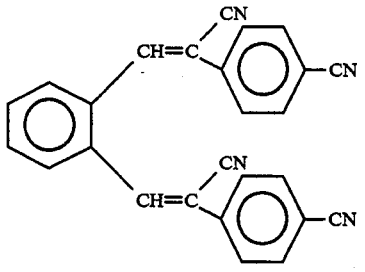

[IV-32]

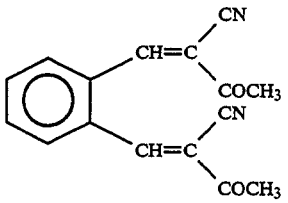

[IV-33]

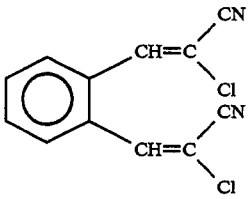

[IV-34]

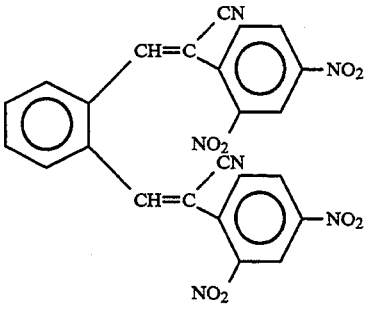

In the general formula [V], $R_{17}$ represents a hydrogen atom (such as chlorine and bromine), a halogen atom, a cyano group or a nitro group;

$R_{18}$ and $R_{19}$ represent respectively a hydrogen atom, a halogen atom, a cyano group, a nitro group, a carboxyl group, an acyl group, an acyloxyl group, an alkoxyalkyl group, —$SO_2R$ (R represents an alkyl group or an aryl group), an alkylcarbonyl group, an alkyl group, a benzyl group or an alkoxycarbonyl group. Preferable $R_{18}$ and $R_{19}$ are the ones having stronger electronattracting properties, such as a halogen atom, a cyano group and a nitro group.

An electronattracting compound of the formula [V] exemplified by the following ones:

[V-1]

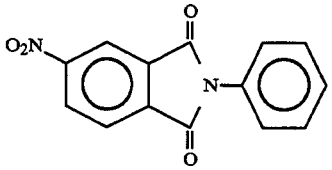

-continued

[V-2]

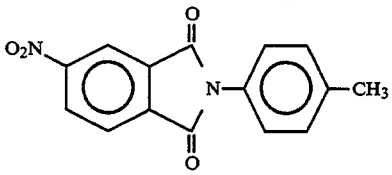

[V-3]

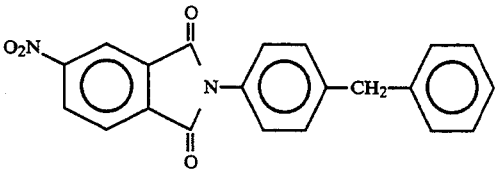

[V-4]

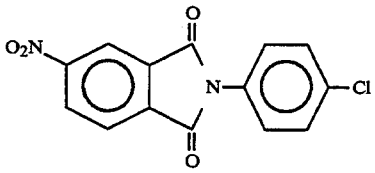

-continued
[V-5]
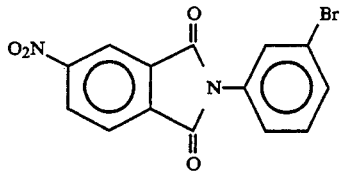
[V-6]
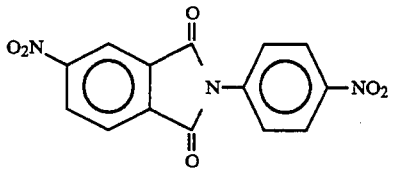
[V-7]
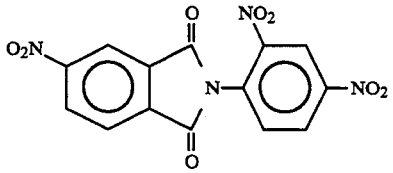
[V-8]
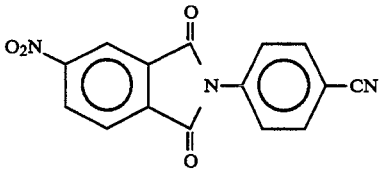
[V-9]
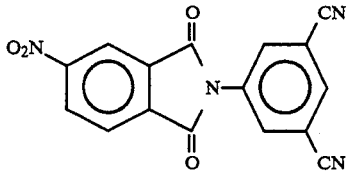
[V-10]
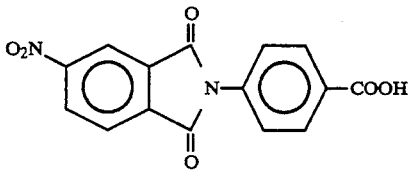
[V-11]
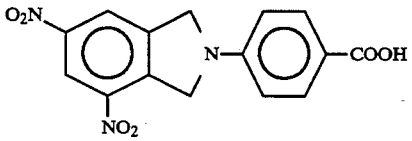
[V-12]
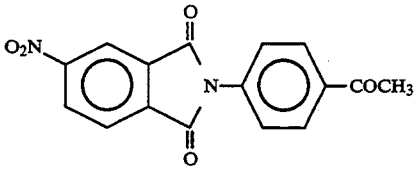
[V-13]
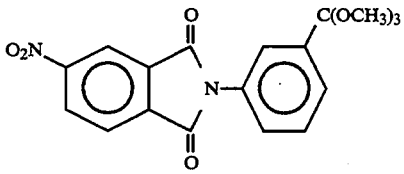
-continued
[V-14]
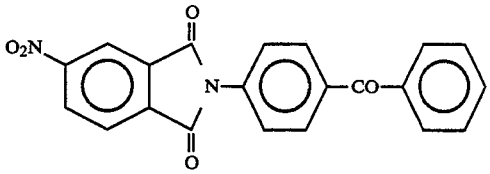
[V-15]
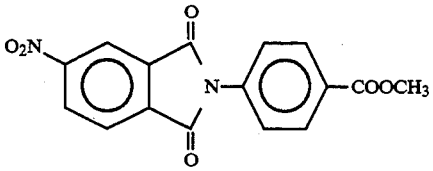
[V-16]
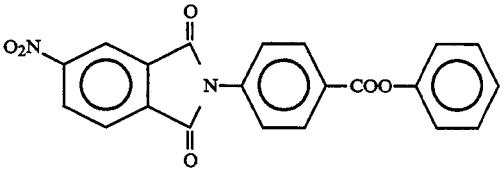
[V-17]
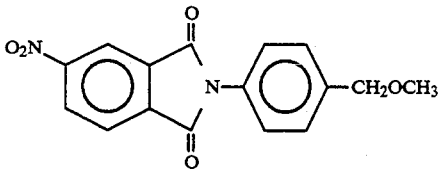
[V-18]
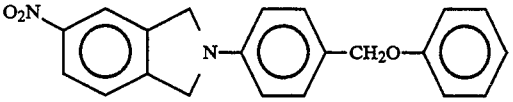
[V-19]
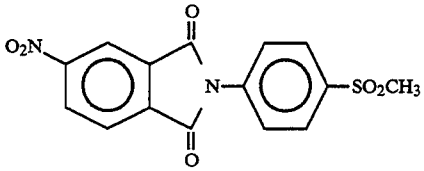
[V-20]
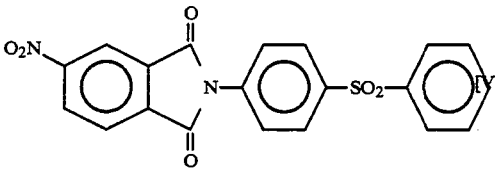
[V-21]
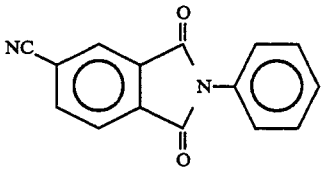
[V-22]
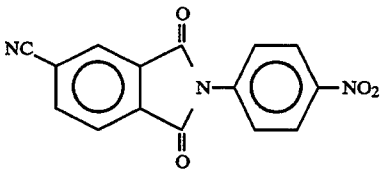

-continued
[V-23]
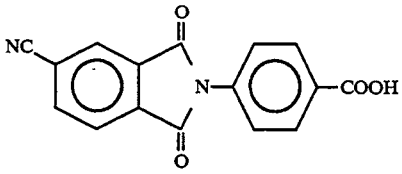
[V-24]
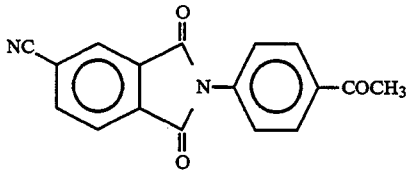
[V-25]
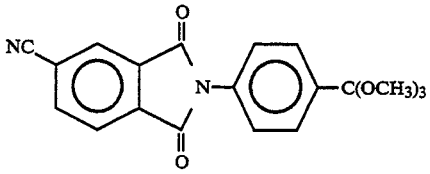
[V-26]
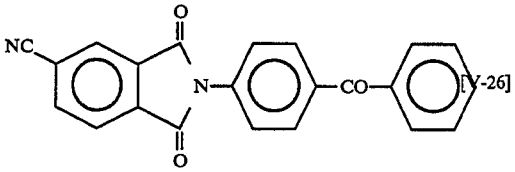
[V-27]
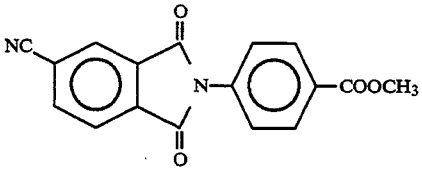
[V-28]
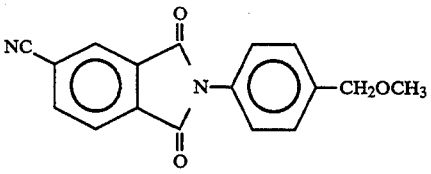
[V-29]
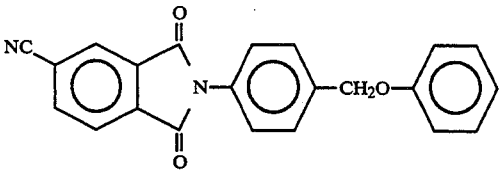
[V-30]
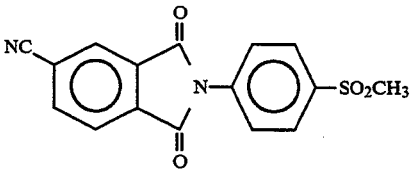
[V-31]
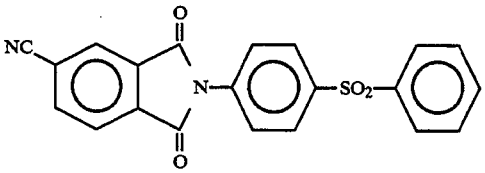
-continued
[V-32]
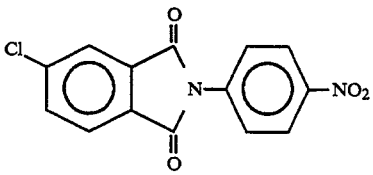
[V-33]
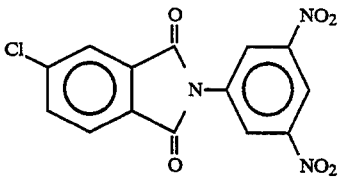
[V-34]
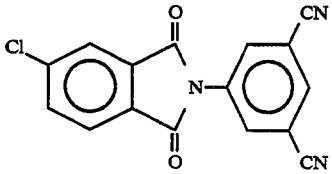
[V-35]
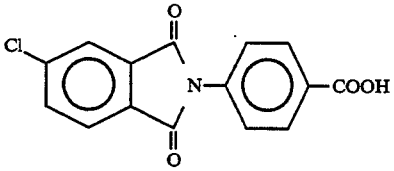
[V-36]
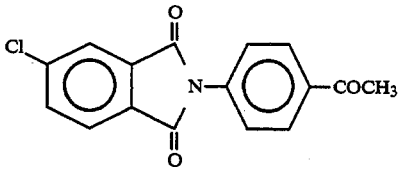
[V-37]
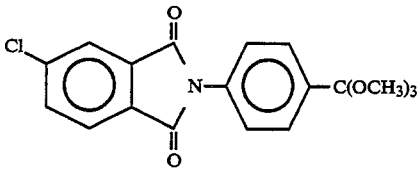
[V-38]
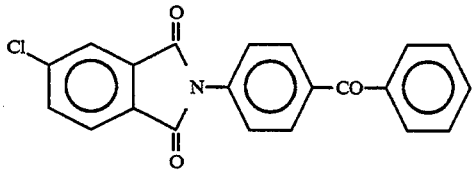
[V-39]
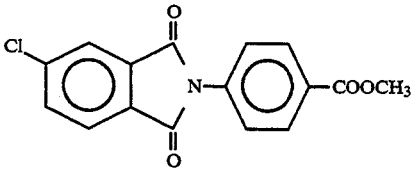
[V-40]
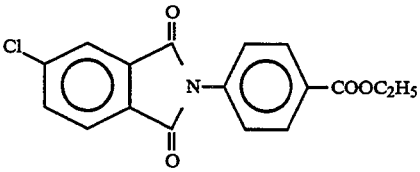

-continued

[V-41]

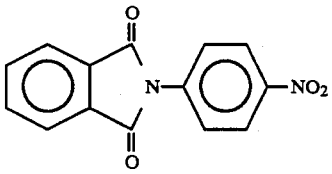

[V-42]

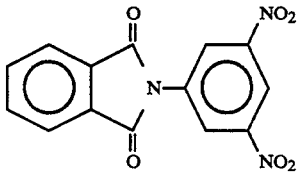

[V-43]

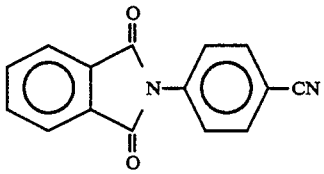

[V-44]

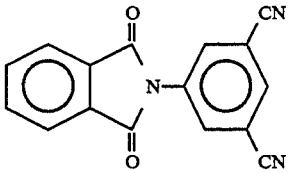

[V-45]

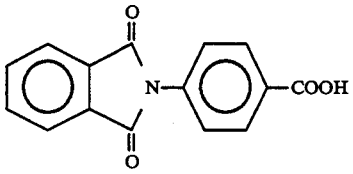

[V-46]

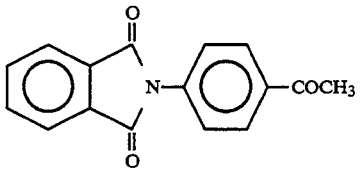

[V-47]

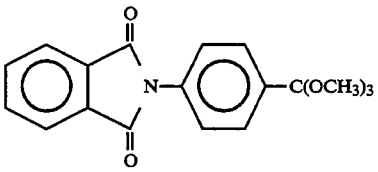

[V-48]

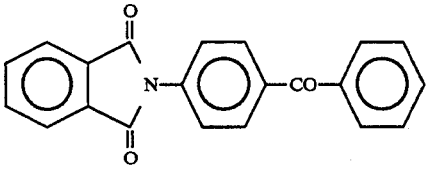

[V-49]

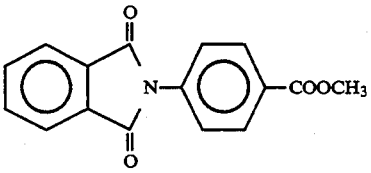

-continued

[V-50]

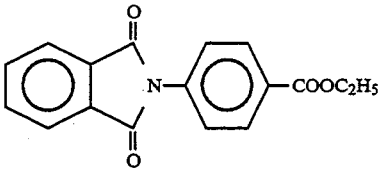

In the present invention, it is preferable that a hindered phenol compound represented by the general formula [VI], [VII] or [VIII] is added in combination with the electronattracting compounds of the formulas [I]–[V].

[VI]

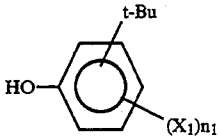

[VII]

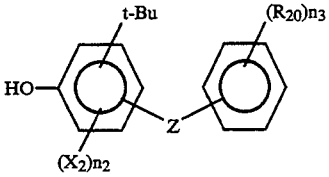

[VIII]

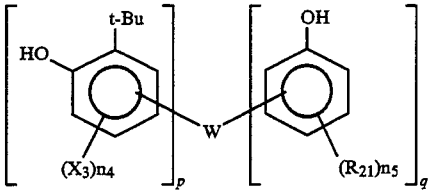

The hindered phenol compounds of the formula [VI]–[VIII] work to prevent the increase of residual potential and to prevent the deterioration of the electronattracting compounds of The formulas [I]–[V].

In the hindered phenol compounds represented by the general formulas [VI], [VII] and [VIII], $X_1$–$X_3$ represent a respectively a hydrogen atom, an $C_1$–$C_4$ alkyl group, an alkoxy group, a hydroxyl group, an aryl group (such as phenyl) or a heterocyclic group (such as triazinylamino and benzotriazolyl). The $C_1$–$C_4$ alkyl group may have a substituent such as a hydroxyl group, a carboxyl group, an ester group, an amino group or a phenyl group.

$n_1$ represents an integer of 0–4. When $n_1$ is 2 or more, $X_1$ may be same or different.

$n_2$ represents an integer of 0–3. When $n_2$ is 2 or more, $X_2$ may be same or different.

$R_{20}$ and $R_{21}$ respectively represent a hydrogen atom, a hydroxyl group, an $C_1$–$C_4$ alkyl group, an alkoxy group, a carbonyloxy group or an aralkyl group or a heterocyclic group such as pyrrolyl, thienyl, triazinyl.

$n_3$ represents an integer of 0–5. When $n_3$ is 2 or more, $R_{20}$ may be same or different.

z represents —O—, —S—, —NH—, —$NR_{22}$—, —$CH_2$—, —$CHR_{23}$— ($R_{22}$ and $R_{23}$ represent respectively an alkyl group or an aryl group, each of which may have a substituent), an alkylene group, an arylene group, an aralkylene group, a bivalent group of alkane carboxylic acid, a bivalent group of alkyl ether;

$n_4$ is an integer of 0–3. $n_5$ is an integer of 0–4. When $n_4$ or $n_5$ is 2 or more, $X_3$ or $R_{21}$ may be same or different.

W represents a bivalent group of an alkyl carboxylate, a bivalent group of an alkyl carboxylate alkyl ether (including thioether), a bivalent group of aryloxycarbonyl ester, a bivalent group of heterocyclic ether, an aralkylene group, di(alkylcarbamoylalkyl), a bivalent group of arylcarboxylate and a bivalent group of hydrazide of carboxylic acid.

P and q represent respectively an integer of 1 or more; the total of p and q is 2–4.

A hindered phenol compound represented by the formula [VI[, [VII] or [VIII] are exemplified by the following ones.

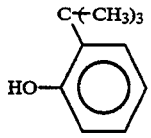

[1]

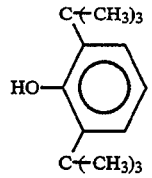

[2]

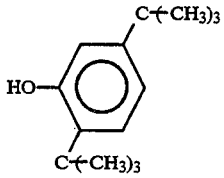

[3]

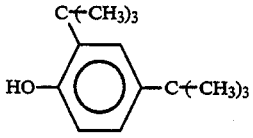

[4]

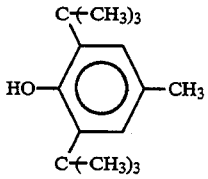

[5]

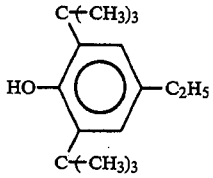

[6]

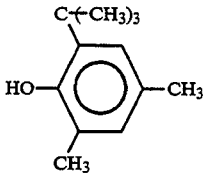

[7]

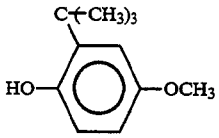

[8]

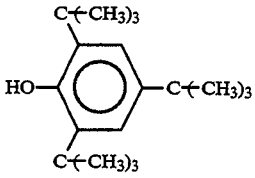

[9]

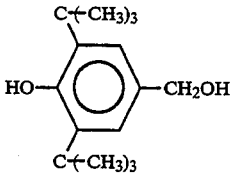

[10]

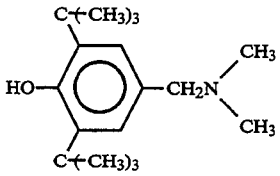

[11]

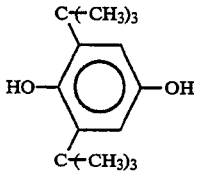

[12]

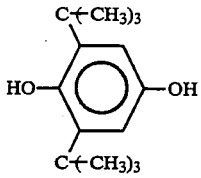

[13]

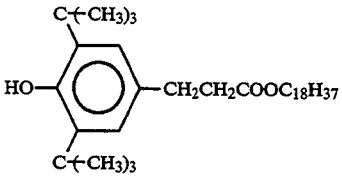

[14]

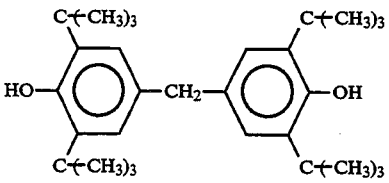

[15]

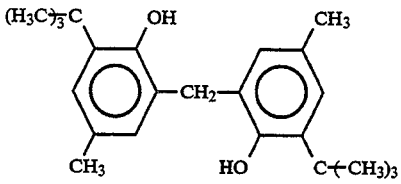

[16]

-continued
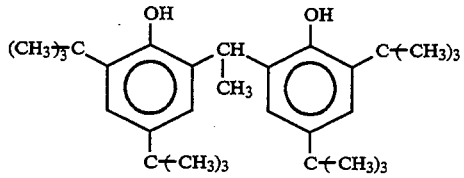
[17]
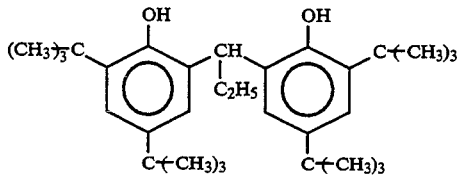
[18]
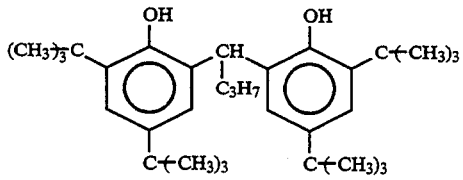
[19]
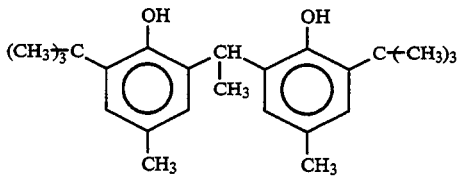
[20]
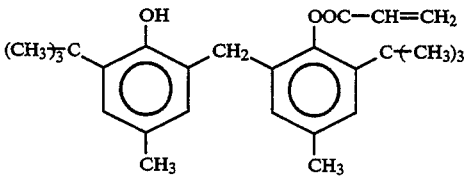
[21]
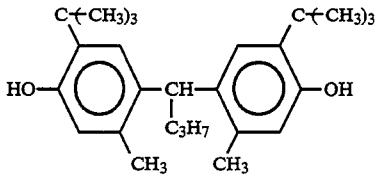
[22]
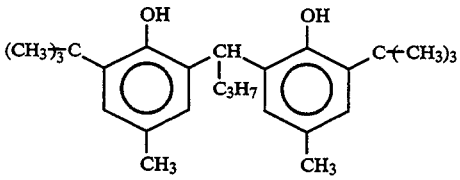
[23]
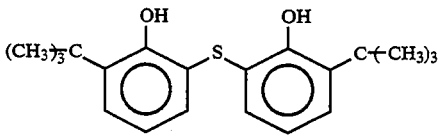
[24]
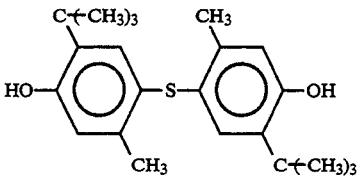
[25]
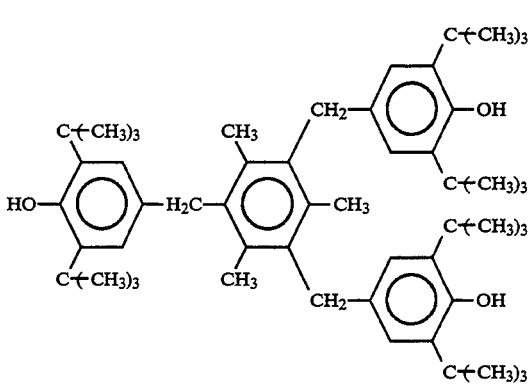
[26]
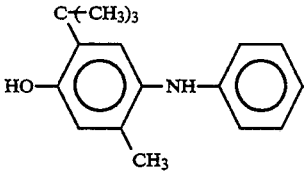
[27]
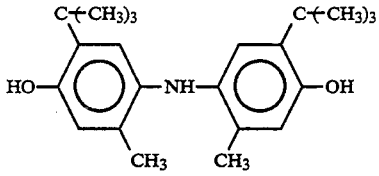
[28]
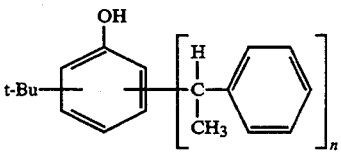
[29]
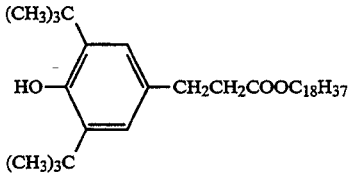
[30]

-continued
[31]
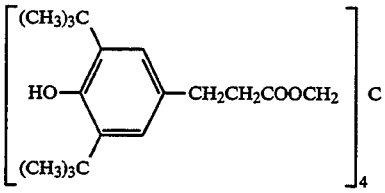
[32]
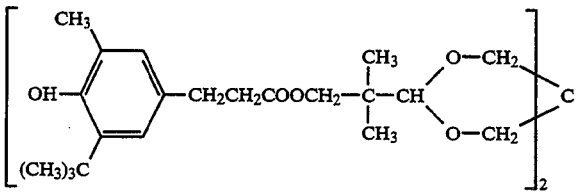
[33]
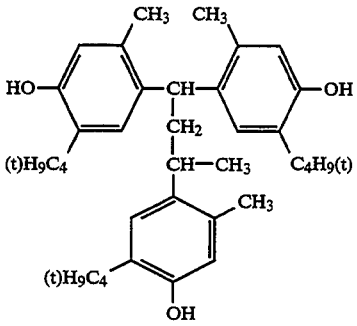
[34]
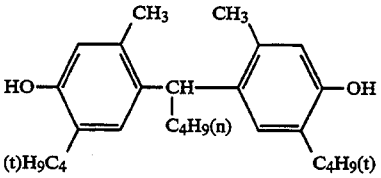
[35]
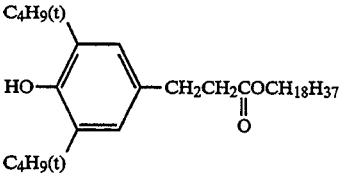
[36]
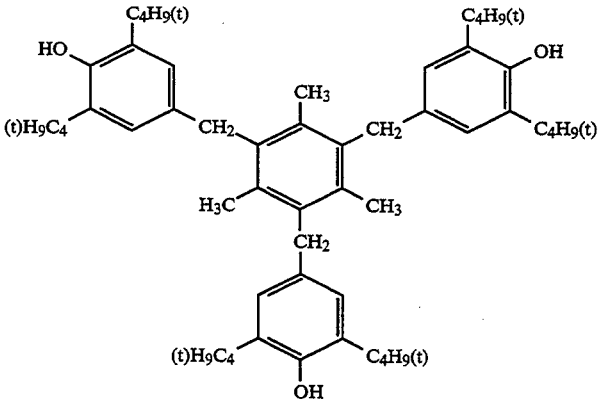
[37]
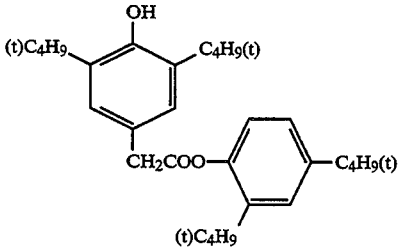
[38]
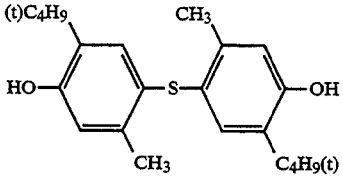
[39]
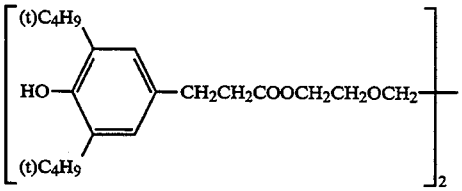
[40]
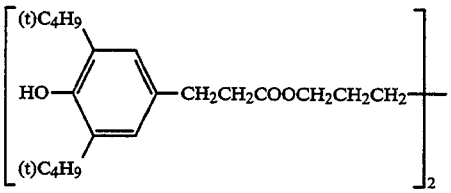
[41]
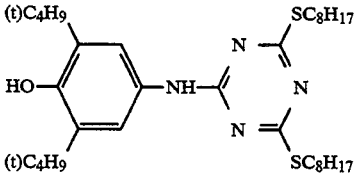
[42]
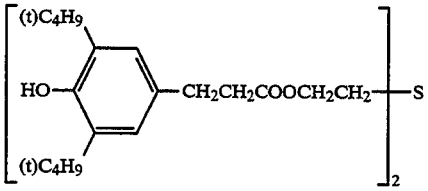

-continued

[43]

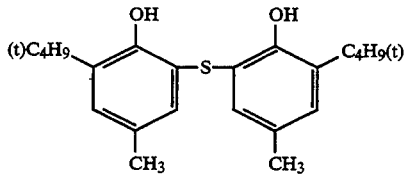

[44]

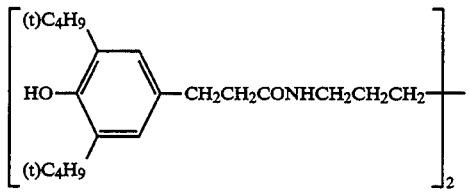

[45]

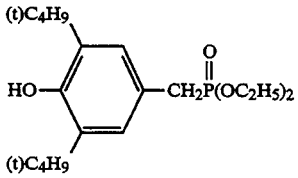

[46]

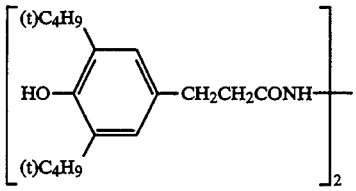

[47]

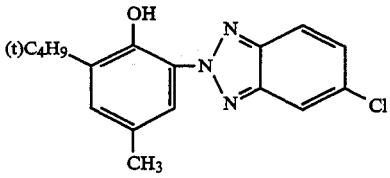

[48]

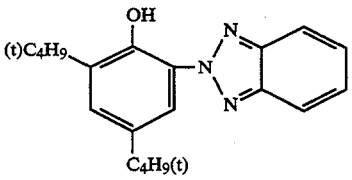

[49]

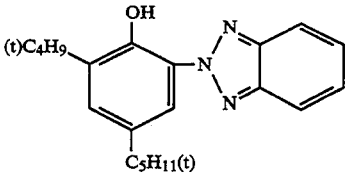

[50]

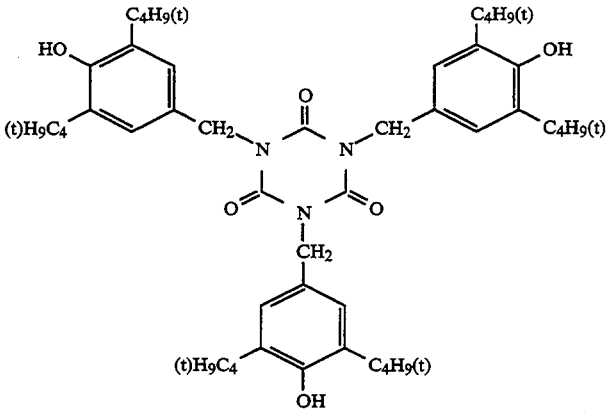

[51]

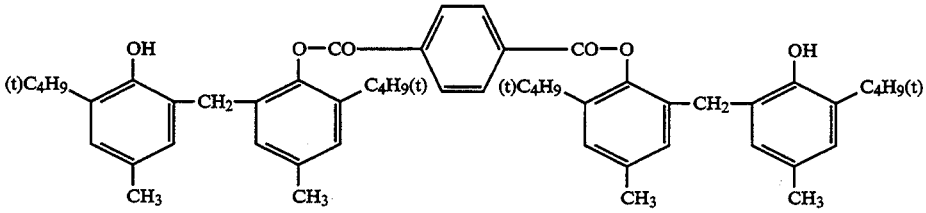

A photosensitive member, various types of which are known, may be any type in the invention.

Figure 2:
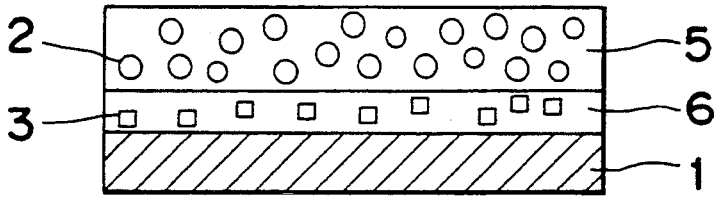
FIG. 2 is a diagram showing the structure of a photosensitive member of the function-divided type comprising a charge generating layer and a charge transporting layer which are formed on an electrically conductive substrate.
Figure 3:
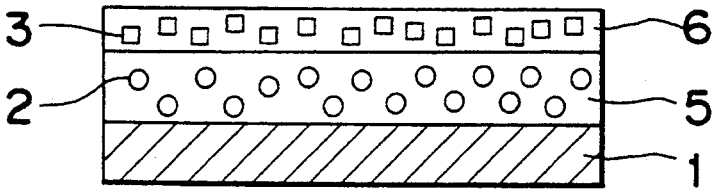
FIG. 3 is a diagram showing the structure of a member of another photosensitive member of the function-divided type comprising a charge generating layer and a charge transporting layer which are formed on an electrically conductive substrate.

For example, a photosensitive member may be a monolayer type as shown in FIG. 1 in which a photosensitive layer (4) is formed on an electrically conductive substrate (1) by dispersing a photoconductive material (3) and a charge transporting material (2) in a binder resin; a laminated type as shown in FIG. 2 in which a photosensitive layer is a function divided type and formed by laminating a charge generating layer (6) containing the photoconductive material (3) on the electrically conductive substrate (1) and then laminating a charge transporting layer (5) containing the charge transporting material (2) is formed on the charge generating layer (6); a laminated type contrary to FIG. 2 as shown in FIG. 3 in which a photosensitive layer is a function divided type and formed by laminating the charge transporting layer (5) containing the charge transporting material (2) on the electrically conductive substrate (1) and then laminating the charge generating layer (6) containing the photoconductive material (3) on the charge transporting layer (5).

Figure 4:
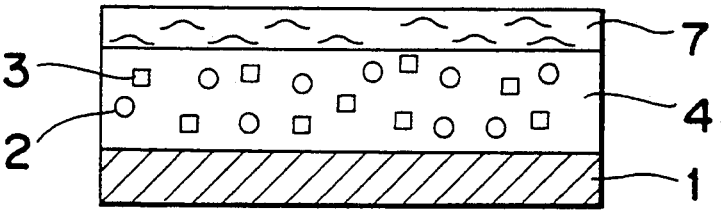
FIG. 4 is a diagram showing the structure of another dispersion-type photosensitive member comprising a photosensitive layer and a surface protective layer formed on an electrically conductive substrate.
Figure 5:
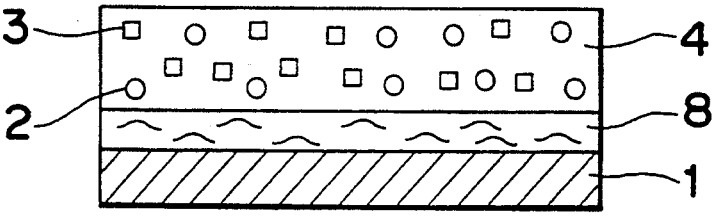
FIG. 5 is a diagram showing the structure of another dispersion-type photosensitive member comprising a photosensitive layer and intermediate layer formed on an electrically conductive substrate.

A photosensitive layer may have a surface protective layer (7) on the photosensitive layer (4) as shown in FIG. 4, and an intermediate layer (8) between the electrically conductive substrate (1) and the photosensitive layer (4) as shown in FIG. 5. The formation of the intermediate layer as shown in FIG. 5 effects adhesivity and coatability between the electrically conductive substrate and the photosensitive layer, protection of the electrically conductive substrate, and improvement of charge injection from the electrically conductive substrate to the photosensitive layer. A photosensitive member of the foregoing laminated and function-divided type may have the above mentioned surface protective layer or intermediate layer.

In the present invention, a photosensitive member of function-divided type is preferable in which a charge generating layer and a charge transporting layer are formed on an electrically conductive substrate in this order.

A charge generating material, a charge transporting material, an electronattracting compound represented by the general formula [I]-[V] and, if desired, a hindered phenol compound represented by the general formula [VI]-[VIII] are dispersed in a resin solution.

The obtained solution is sprayed on the electrically conductive substrate and dried. The thickness of the photosensitive layer is 3-30 μm, preferably 5-20 μm.

In this case, the charge transporting material is generally used at an amount of 0.01-2 parts by weight on the basis of 1 part by weight of a binder resin. The electronattracting material is used at an amount of 0.01-10% by weight, preferably 0.05-5% by weight on the basis of the charge transporting material. When the content is less than 0.01% by weight, the increase of residual potential is not restrained. When the content is larger than 10% by weight, the initial surface potential decreases.

When a hindered phenol is added, this compound is contained at a content of 1-30% by weight on the basis of the charge transporting material. Preferable content is 5-20% by weight when an electronattracting compound of [I]-[III] is used. Preferable content is 5-25% by weight when an electronattracting compound of [IV] or [V] is used. The content is less than 1% by weight, the increase of residual potential is not restrained. The content is larger than 30% by weight, the sensitivity is lowered. It is noted that the amount of the hindered phenol compound, when added, is used generally more than that of the electronattracting compound.

The sensitivity is poor if the charge generating material is used in an insufficient quantity, whereas the chargeability is poor and the mechanical strength of photosensitive layer is inadequate if used to excess. Therefore, the amount of the charge generating material contained in the photosensitive layer is within the range of 0.01-2 parts by weight, preferably 0.2-1.2 parts by weight on the basis of one part by weight of resin. If a charge transporting material such as polyvinylcarbazole, which is capable of being used as a binder itself, is used, an addition amount of the charge generating material is preferably 0.01-0.5 parts by weight on the basis of one part by weight of charge transporting materials.

And then, a photosensitive member of laminated type as shown in FIG. 2 is explained for its formation.

In order to form a photosensitive member of a laminated type, a charge generating material is deposited in a vacuum on an electrically conductive substrate, a charge generating material is dissolved in an adequate solvent to apply onto an electrically conductive substrate or an application solution containing a charge generating material and, if necessary, binder resin dissolved in an appropriate solvent is applied onto an electrically conductive substrate to be dried, for the formation of a charge generating layer on the electrically conductive substrate. Then, a solution containing a charge transporting material and a binder is applied onto the charge generating layer followed by drying for the formation of a charge transporting layer.

In such a laminated type photosensitive member, it is preferable that an electronattracting compound of [I]-[V] and, if desired, a hindered phenol compound of [VI-[VIII] are contained in the charge transporting layer.

In the charge transporting layer, the charge transporting material is contained at a content of 0.2-2 parts by weight, preferably 0.3-1.3 parts by weight on the basis of binder resin. The electronattracting compound of [I]-[V] is contained at a content of 0.01-10% by weight, preferably 0.05-5% by weight on the basis of the charge transporting material because of the same reasons as described in the monolayered type. The hindered phenol compound of [VI]-[VIII], when added, is contained at a content of 1-30% by weight, preferably 5-20% by weight on the basis of the charge transporting material because of the same reasons as described in the monolayered type. The amount of the hindered phenol compound, when added, is used more than that of the electronattracting compound.

The thickness of the charge generating layer is 4 μm or less, preferably, 2 μm or less. It is suitable that the charge-transporting layer has a thickness in the range 3-50 μm, preferably 5-30 μm.

From the viewpoint of the removal of trapping points of electrical charges, a hindered phenol compound of the present invention may be added into a charge generating layer.

A photosensitive member of a laminated type shown in FIG. 3 can be formed similarly as described in explanation of FIG. 2.

Applicable as binder resin for formation of a photosensitive member of monolayered type (FIG. 1) and laminated type (FIG. 2 and FIG. 3) are any of the thermoplastic resins and thermosetting resins which are publically known to be electrically insulating and any of the photocuring resins and phtoconductive resins.

Some examples of the suitable binders for the production of a photosensitive member are thermoplastic resins such as saturated polyester, polyamide, acrylic, ethylene-vinyl acetate copolymer, ion cross-linked olefin copolymer (ionomer), styrene-butadiene block copolymer, polycarbonate, vinyl chloride-vinyl acetate copolymer, cellulose ester, polyimide, styrol, etc., and thermosetting resins such as, epoxy, urethane, silicone, phenolic, melamine, xylene, alkyd, thermosetting acrylic, etc., and photocuring resins, and photoconductive resins such as poly-N-vinyl carbazole, polyvinyl pyrene, polyvinyl anthracene, polyvinylpyrrole, etc., all named without any significance of restricting the use of them. Any of these resins can be used singly or in combination with other resins. It is desirable for any of these electrically insulating resins to have a volume resistance of $1\times10^{12}$ Ω·cm or more when measured singly.

A charge generating material useful for the formation of a photosensitive member is exemplified by organic substances such as bisazo dyes, triarylmethane dyes, thiazine dyes, oxazine dyes, xanthene dyes, cyanine coloring agents, styryl coloring agents, pyrylium dyes, thiapyrylium dyes, azo pigments, quinacridone pigments, indigo pigments, perylene pigments, polycyclic quinone pigments, bisbenzimidazole pigments, indanthrone pigments, squalylium pigments, azulene coloring agents, phthalocyanine pigments and pyrrolopyrrole; and inorganic substances such as selenium, selenium-tellurium, selenium arsenic, cadmium sulfide, cadmium selenide, zinc oxide and amorphous silicon. Any other material is also usable insofar as it generates charge carriers very efficiently upon adsorption of light. A charge generating material which can be deposited in vacuum is exemplified by phthalocyanines such as metal free phthalocyanine, titanylphthalocyanine and alumichrophthacyanine.

Illustrative examples of charge transporting materials for formation of a photosensitive member are hydrazone compounds, pyrazoline compounds, styryl compounds, triphenylmethane compounds, oxadiazol compounds, carbazole compounds, stilbene compounds, enamine compounds, oxazole compounds, triphenylamine compounds, tetraphenylbenzidine, azine compounds and the like, including carbazole, N-ethylcarbazole, N-vinylcarbazole, N-phenylcarbazole, tethracene, chrysene, pyrene, perylene, 2-phenylnaphthalene, azapyrene, 2,3-benzochrysene, 3,4-benzopyrene, fluorene, 1,2-benzofluorene, 4-(2-fluorenylazo)resorcinol, 2-p-anisolaminofluorene, p-diethylaminoazobenzene, cadion, N,N-dimethyl-p-phenylazoaniline, p-(dimethylamino)stilbene, 1,4-bis(2-methylstyryl)benzene, 9-(4-diethylaminostyryl) anthracene, 2,5-bis(4-diethylaminophenyl)-1,3,5-oxadiazole, 1-phenyl-3-(p-diethylaminostyryl)-5-(p-diethylaminophenyl)-pylazoline, 1-phenyl-3-phenyl-5-pylazolone, 2-(m-naphthyl)-3-phenyloxazole, 2-(p-diethylaminostyryl)-6-diethylaminobenzoxazole, 2-(p-diethylaminostyryl)-6-diethylaminobenzothiazole, bis(4-diethylamino-2-methylphenyl)phenylmethane, 1.1-bis(4-N,N-diethylamino-2-ethylphenyl)heptane, N,N-diphenylhydrazino-3-methylidene-10-ethylphenoxazine, N,N-diphenylhydrazino-3-methylidene- 10-ethylphenothiazine, 1,1,2,2,-tetrakis-(4-N,N-diethylamino-2-ethylphenyl)ethane, p-diethylaminobenzaldehyde-N,N-diphenylhydrazone, p-diphenylaminobenzaldehyde-N,N-diphenylhydrazone, N-ethylcarbazole-N-methyl-N-phenylhydrazone, p-diethylaminobenzaldehyde-N-α-naphthyl-N-phenylhydrazone, p-diethylaminobenzaldehyde-3-methylbenzothiazolinone-2-hydrazone, 2-methyl-4-N,N-diphenylamino-β-phenylstilbene, α-phenyl-4-N,N-diphenylaminostilbene, 1,1-bis(p-diethylaminophenyl)-4,4-diphenyl-1,3-butadiene and the like. Any of these charge transporting materials can be used singly or in combination with other charge transporting materials.

The charge transporting layer permits the incorporation of a sensitizer, a bodying agent, a surfactant and the like which are per se known.

A surface protective layer as shown in FIG. 4 may be formed with polymer itself such as acrylic resin, polyarylate resin, polycarbonate resin and urethane resin, or formed by dispersing a material with low electroconductivity such as tin oxide, indium oxide. Organic plasma polymerized layer can be also applied and this layer may contain oxygen, nitrogen, halogen atoms of Group III or V in the Periodic Table if necessary. The thickness of a surface protective layer is desirably 5 μm or less.

When an intermediate layer as shown in FIG. 5 is formed, examples of suitable materials contained in these layers are polyimide, polyamide, nitrocellulose, polyvinyl butyral, polyvinyl alcohol. A compound having low electrical resistance such as tin oxide and indium oxide is dispersed in the surface protective layer. Aluminum oxide, zinc oxide and silicon oxide may be deposited to form the surface protective layer.

It is preferable that the thickness of the layer is 1 μm or less.

An electrically conductive substrate is exemplified by a sheet or a drum made of metal or alloy such as copper, aluminum, silver, iron and nickel; a substrate such as a plastic film on which the foregoing metal or alloy is adhered by a vacuum-deposition method or an electroless plating method and the like; a substrate such as a plastic film and paper on which an electroconductive layer is formed by applying or depositing electroconductive polymer, indium oxide, tin oxide etc.

The present invention is explained by concrete examples hereinafter. In the examples, "part(s)" means "part(s) by weight" if not particularly limited.

EXAMPLE 1

An aluminum drum (outer diameter: 80 mm, length: 350 mm) was used as an electrically substrate.

The bisazo compound (0.45 parts) represented by the chemical formula below:

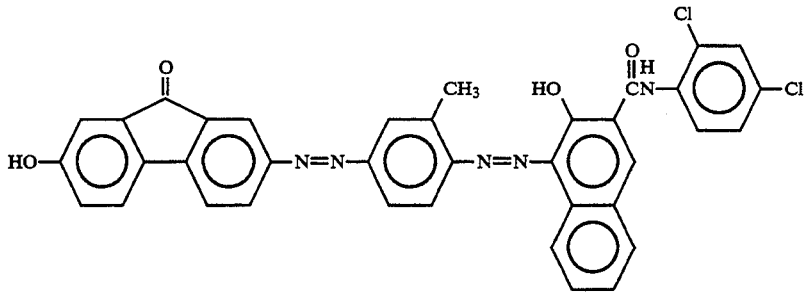

polyvinyl butyral resin (BX-1; made by Sekisui Kagaku Kogyo K.K.) of 0.45 parts and cyclohexanone of 50 parts were placed in Sand mill for dispersion. The dispersion solution of the bisazo compound was applied onto the aluminum drum to form a charge generating layer so that the thickness of dried layer would be 0.3 g/m$^2$.

A solution containing the distyryl compound represented by the following chemical formula below:

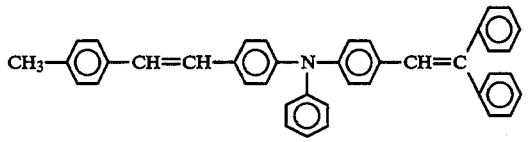

of 40 parts, polycarbonate resin (Panlite K-1300; made by Teijin Kasei K.K.) of 60 parts, the electronattracting compound [I-2] of 0.2 parts and dimethyl silicone oil (KF-69; made by Shinetsu Kagaku K.K.) of 0.01 part dissolved in 1,4-dioxane of 400 parts was applied onto the charge generating layer to form a charge transporting layer so that the thickness of dried layer would be 20 microns. Thus, a photosensitive member with two layers was prepared.

EXAMPLES 2–4

Photosensitive members were prepared in a manner similar to Example 1 except that the electronattracting compounds [I-3], [I-4] and [I-5] were used respectively instead of the compound [I-2].

EXAMPLE 4

Metal-free phthalocyanine of 0.45 parts, polystyrene resin (molecular weight: 40000) of 0.45 parts, 1,1,2-trichloroethane of 50 parts were placed in Sand mill for dispersion. The dispersion solution of the phthalocyanine pigment was applied onto the aluminum drum to form a charge generating layer so that the thickness of dried layer would be 0.2 g/m$^2$.

A solution containing the hydrazone compound represented by the following chemical formula below:

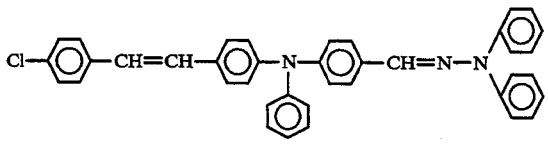

of 50 parts, polycarbonate resin (PC-Z; made by Mitsubishi Gasu Kagaku K.K.) of 50 parts, the hindered phenol compound [2] of 5 parts, the electronattracting compound [I-9] of 0.5 parts and fluorosilicone oil (FL-100; made by Shinetsu Kagaku K.K.) of 0.1 part dissolved in tetrahydrofuran of 400 parts was applied onto the charge generating layer to form a charge transporting layer so that the thickness of dried layer would be 20 microns. Thus, a photosensitive member with two layers was prepared.

EXAMPLES 6–9

Photosensitive members were prepared in a manner similar to Example 5 except that the electronattracting compounds [I-12], [I-14] and [I-15] were used respectively instead of the compound [I-9].

EXAMPLE 10

Copper phthalocyanine of 50 parts and tetranitro-copper phthalocyanine of 0.2 parts were dissolved in 98% conc. sulfic acid of 500 parts with stirring. The solution was poured into water of 5000 parts to deposit a photoconductive composition of copper phthalocyanine and tetranitro-copper phthalocyanine. The obtained composition was filtered, washed and dried at 120° C. under vacuum conditions.

The photosensitive composition obtained above of 10 parts, thermosetting acrylic resin (Acrydick A405; made by Dainippon Ink K.K.) of 22.5 parts, melamine resin (Super Beckamine J 820; made by Dainippon Ink K.K.) of 7.5 parts, the hydrozone compound represented by the chemical formula below:

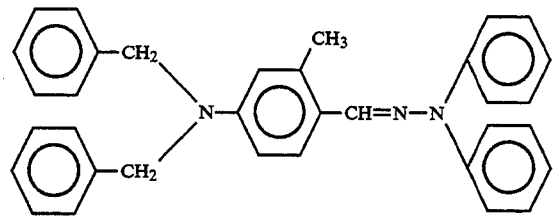

of 15 parts, the electronattracting compound [I-20] of 0.1 part and the hindered phenol compound [41] of 1.5 parts and mixed solution of methyl ethyl ketone and xylene (1:1) of 100 parts were placed in a ball mill pot for dispersion. The mixture was mixed for dispersion for 48 hours to give a photosensitive application solution. The application solution is applied onto an aluminum substrate and dried. Thus, a photosensitive layer having thickness of 15 microns was formed.

EXAMPLES 11–14

Photosensitive members were prepared in a manner similar to Example 1 except that the electronattracting compounds [II-2], [II-3], [II-4] and [II-5] were used respectively to form a charge transporting layer instead of the electronattracting compound [I-2] used in Example 1.

EXAMPLES 15–19

Photosensitive members were prepared in a manner similar to Example 5 except that the electronattracting compounds [II-8], [II-10], [II-11], [II-14] and [II-17] were used respectively to form a charge transporting layer instead of the electronattracting compound [I-9] used in Example 5.

EXAMPLE 20

A photosensitive member was prepared in a manner similar to Example 10 except that the electronattracting compound [II-19] was used to form a charge transporting layer instead of the electronattracting compound [I-20] used in Example 10.

EXAMPLES 21–24

Photosensitive members were prepared in a manner similar to Example 1 except that the electronattracting compounds [III-2], [III-3], [III-4] and [III-7] were used respectively to form a charge transporting layer instead of the electronattracting compound [I-2] used in Example 1.

EXAMPLES 25–29

Photosensitive members were prepared in a manner similar to Example 5 except that the electronattracting compounds [III-9], [III-10], [III-12], [III-15] and [III-16] were used respectively to form a charge transporting layer instead of the electronattracting compound [I-9] used in Example 5.

EXAMPLE 30

A Photosensitive member was prepared in a manner similar to Example 10 except that the electronattracting compound [III-8] was used to form a charge transporting layer instead of the electronattracting compound [I-20] used in Example 10.

EXAMPLE 31

A charge generating layer was formed on an electrically conductive substrate (the same as that in Example 1).

A solution containing the styryl compound (the same as that used in Example 1 of 40 parts, polycarbonate resin (Panlite K-1300; made by Teijin Kasei K.K.) of 60 parts, the hindered phenol compound [2] of 4 parts, the electronattracting compound [IV-1] of 0.2 parts and dimethylsilicone oil (KF-69; made by Shinetsu Kagaku K.K.) of 0.01 part dissolved in tetrahydrofuran of 400 parts was applied onto the charge generating layer to form a charge transporting layer so that the thickness of dried layer would be 20 μm,. Thus, a photosensitive member with two layers was prepared.

EXAMPLES 32–37

Photosensitive members were prepared in a manner similar to Example 31 except that the hindered phenol compound and the electronattracting compound shown in Table 1 below were used.

TABLE 1

| | hindered phenol compound | electronattracting compound |
|---|---|---|
| EXAMPLE 32 | [5] | [IV-2] |
| EXAMPLE 33 | [15] | [IV-3] |
| EXAMPLE 34 | [17] | [IV-7] |
| EXAMPLE 35 | [20] | [IV-8] |
| EXAMPLE 36 | [24] | [IV-10] |
| EXAMPLE 37 | [29] | [IV-15] |

EXAMPLES 38

Photosensitive members were prepared in a manner similar to Example 5 except that a metal free phthalocyanine of τ-type was used, the hindered phenol compound [31] was used instead of [2] and that the electronattracting compound [IV-1] was used instead of [I-9], to form a charge transporting layer.

EXAMPLES 39–42

Photosensitive members were prepared in a manner similar to Example 38 except that the hindered phenol compound [31] was used at the amount of 2.5 parts, 7.5 parts, 10 parts and 15 parts to form a charge transporting layer.

EXAMPLES 43–47

Photosensitive members were prepared in a manner similar to Example 38 except that the hindered phenol compound and the electronattracting compound shown in Table 2 below were used.

TABLE 2

| | hindered phenol compound | electronattracting compound |
|---|---|---|
| EXAMPLE 43 | [33] | [IV-9] |
| EXAMPLE 44 | [34] | [IV-16] |
| EXAMPLE 45 | [37] | [IV-10] |
| EXAMPLE 46 | [41] | [IV-12] |
| EXAMPLE 47 | [44] | [IV-1] |

EXAMPLES 48

Titanylphthalocyanine of 0.45 parts, bytyral resin (BX-1; made by Sekisui Kagaku K.K.) of 0.45 parts, and tetrahydrofuran of 50 parts, and tetrahydrofuran of 50 parts were dispersed in Paint-conditioner. The dispersion solution of the phthalocyanine pigment was applied onto an aluminum drum to form a charge generating layer so that the thickness of dried layer would be 0.2 g/m$^2$.

A solution containing the benzyldiphenyl compound represented by the following chemical formula below:

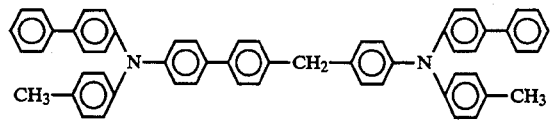

of 50 parts, polycarbonate resin (K-1300, made by Teijin Kasei K.K.) of 50 parts, the hindered phenol compound [5] of 10 parts, the electronattracting compound [IV-19] of 1 part and dimethyl silicone oil (KF-90; made by Shinetsu Kagaku K.K.) of 0.01 part dissolved in dichloromethane of 400 parts was applied onto the charge generating layer to form a charge transporting layer so that the thickness of dried layer would be 20 microns. Thus, a photosensitive member of function divided type was prepared.

EXAMPLES 49–51

Photosensitive members were prepared in a manner similar to Example 48 except that the hindered phenol compound and the electronattracting compound shown in Table 3 below were used.

TABLE 3

| | hindered phenol compound | electronattracting compound |
|---|---|---|
| EXAMPLE 49 | [17] | [IV-21] |
| EXAMPLE 50 | [31] | [IV-27] |
| EXAMPLE 51 | [41] | [IV-34] |

EXAMPLES 52–58

Photosensitive members were prepared in a manner similar to Example 31 except that the hindered phenol compound and the electronattracting compound shown in Table 4 below were used.

TABLE 4

| | hindered phenol compound | electronattracting compound |
|---|---|---|
| EXAMPLE 52 | [2] | [IV-4] |
| EXAMPLE 53 | [5] | [V-6] |
| EXAMPLE 54 | [15] | [IV-9] |
| EXAMPLE 55 | [17] | [V-10] |
| EXAMPLE 56 | [20] | [V-13] |
| EXAMPLE 57 | [24] | [V-16] |
| EXAMPLE 58 | [29] | [V-20] |

EXAMPLE 59

A Photosensitive member was prepared in a manner similar to Example 5 except that 0.01 part of fluorosilicone was added, the hindered phenol compound [34] was used instead of [2]and the electronattracting compound [V-22] was used instead of [I-9], to form a charge transporting layer.

EXAMPLES 60–63

Photosensitive members were prepared in a manner similar to Example 59 except that the hindered phenol compound [34] was used at the amount of 2.5 parts, 7.5 parts, 10 parts and 15 parts to form a charge transporting layer.

EXAMPLES 64–68

Photosensitive members were prepared in a manner similar to Example 5 except that the hindered phenol compound and the electronattracting compound shown in Table 5 below were used.

TABLE 5

| | hindered phenol compound | electronattracting compound |
|---|---|---|
| EXAMPLE 64 | [36] | [IV-23] |
| EXAMPLE 65 | [41] | [V-28] |
| EXAMPLE 66 | [43] | [V-32] |
| EXAMPLE 67 | [45] | [V-34] |
| EXAMPLE 68 | [48] | [V-37] |

COMPARATIVE EXAMPLES

Photosensitive members were prepared in a manner similar to Example 1 except that the hindered phenol compound and the electronattracting compound shown in Table 6 below were used at an amount shown in Table 6.

In Table 6, [A], [B] and [C] mean respectively

[A]: 2, 4, 7-trinitrofluorenone

[B]: 3,5-dinitrobenzoic acid

[C]: 4-nitro-($\beta$,$\beta$-dicyanovinyl)-benzene

TABLE 6

| Comparative Example | electronattracting compound (part(s)) | hindered phenol compounds (part(s)) |
|---|---|---|
| 1 | — | — |
| 2 | — | [2] 4 |
| 3 | [A] 0.2 | — |
| 4 | [B] 0.2 | — |
| 5 | [C] 0.2 | — |

The resultant photosensitive member was installed in a copying machine (EP-470Z; made by Minolta Camera K.K.) and corona-charged by power of −6 KV level to evaluate initial surface potential $V_0$ (V), half-reducing amount (E (lux.sec)) and dark decreasing ratio of the initial surface potential ($DDR_1$). E means an exposure amount required to reduce the initial surface potential to half the value. $DDR_1$ is a decreasing ratio of the initial surface potential after the photosensitive member was left for 1 second in the dark.

The results are shown in Table 7 and Table 8.

TABLE 7

| | $V_0$ (V) | E (lux.sec) | $DDR_1$ |
|---|---|---|---|
| EXAMPLE 1 | −650 | 0.8 | 2.8 |
| EXAMPLE 2 | −650 | 0.8 | 2.9 |
| EXAMPLE 3 | −650 | 0.9 | 3.0 |
| EXAMPLE 4 | −650 | 0.8 | 2.7 |
| EXAMPLE 5 | −650 | 0.9 | 2.9 |
| EXAMPLE 6 | −640 | 0.9 | 3.3 |
| EXAMPLE 7 | −650 | 1.0 | 3.0 |
| EXAMPLE 8 | −640 | 0.9 | 3.2 |
| EXAMPLE 9 | −620 | 0.9 | 12.0 |
| EXAMPLE 10 | +620 | 0.9 | 12.4 |
| EXAMPLE 11 | −650 | 0.8 | 3.0 |
| EXAMPLE 12 | −650 | 0.9 | 2.8 |
| EXAMPLE 13 | −650 | 0.9 | 2.9 |
| EXAMPLE 14 | −650 | 0.8 | 2.8 |
| EXAMPLE 15 | −650 | 1.0 | 3.0 |
| EXAMPLE 16 | −650 | 0.9 | 2.8 |
| EXAMPLE 17 | −660 | 1.0 | 2.6 |
| EXAMPLE 18 | −650 | 0.9 | 2.9 |
| EXAMPLE 19 | −640 | 1.2 | 3.3 |

TABLE 7-continued

| | $V_0$ (V) | E (lux.sec) | $DDR_1$ |
|---|---|---|---|
| EXAMPLE 20 | +620 | 0.9 | 12.4 |
| EXAMPLE 21 | −650 | 0.8 | 2.8 |
| EXAMPLE 22 | −650 | 0.8 | 3.0 |
| EXAMPLE 23 | −640 | 0.8 | 3.2 |
| EXAMPLE 24 | −650 | 0.9 | 2.7 |
| EXAMPLE 25 | −650 | 0.9 | 2.9 |
| EXAMPLE 26 | −640 | 0.8 | 3.3 |
| EXAMPLE 27 | −650 | 0.9 | 3.0 |
| EXAMPLE 28 | −650 | 0.8 | 2.8 |
| EXAMPLE 29 | −630 | 1.0 | 12.5 |
| EXAMPLE 30 | +620 | 0.9 | 12.4 |
| EXAMPLE 31 | −650 | 0.8 | 2.8 |
| EXAMPLE 32 | −650 | 0.9 | 2.9 |
| EXAMPLE 33 | −650 | 0.8 | 2.8 |
| EXAMPLE 34 | −650 | 0.8 | 3.0 |
| EXAMPLE 35 | −650 | 0.9 | 2.9 |
| EXAMPLE 36 | −650 | 0.8 | 2.7 |
| EXAMPLE 37 | −650 | 0.8 | 3.0 |
| EXAMPLE 38 | −650 | 1.0 | 2.8 |
| EXAMPLE 39 | −640 | 1.0 | 3.3 |
| EXAMPLE 40 | −650 | 1.0 | 2.6 |
| EXAMPLE 41 | −660 | 1.1 | 2.4 |
| EXAMPLE 42 | −680 | 1.2 | 2.0 |
| EXAMPLE 43 | −650 | 1.0 | 2.6 |
| EXAMPLE 44 | −650 | 1.1 | 2.8 |
| EXAMPLE 45 | −650 | 1.0 | 2.7 |
| EXAMPLE 46 | −650 | 1.0 | 3.0 |
| EXAMPLE 47 | −650 | 0.9 | 2.7 |
| EXAMPLE 48 | −660 | 0.7 | 2.3 |
| EXAMPLE 49 | −650 | 0.7 | 2.6 |
| EXAMPLE 50 | −660 | 0.8 | 2.4 |
| EXAMPLE 51 | −650 | 0.7 | 2.7 |
| EXAMPLE 52 | −650 | 0.8 | 2.8 |
| EXAMPLE 53 | −650 | 0.9 | 2.9 |
| EXAMPLE 54 | −650 | 0.8 | 2.8 |
| EXAMPLE 55 | −650 | 0.8 | 3.0 |
| EXAMPLE 56 | −650 | 0.9 | 2.9 |
| EXAMPLE 57 | −650 | 0.8 | 2.7 |
| EXAMPLE 58 | −650 | 0.8 | 3.0 |
| EXAMPLE 59 | −650 | 1.0 | 2.8 |
| EXAMPLE 60 | −640 | 1.0 | 3.3 |
| EXAMPLE 61 | −650 | 1.0 | 2.7 |
| EXAMPLE 62 | −660 | 1.1 | 2.5 |
| EXAMPLE 63 | −680 | 1.2 | 2.0 |
| EXAMPLE 64 | −650 | 1.0 | 2.6 |
| EXAMPLE 65 | −650 | 1.1 | 2.8 |
| EXAMPLE 66 | −650 | 1.0 | 2.9 |
| EXAMPLE 67 | −650 | 1.0 | 3.0 |
| EXAMPLE 68 | −640 | 0.9 | 3.0 |

TABLE 8

| | $V_0$ (V) | E (lux.sec) | $DDR_1$ |
|---|---|---|---|
| COMPARATIVE EXAMPLE 1 | −660 | 1.2 | 2.3 |
| COMPARATIVE EXAMPLE 2 | −660 | 1.3 | 2.4 |
| COMPARATIVE EXAMPLE 3 | −640 | 0.8 | 3.8 |
| COMPARATIVE EXAMPLE 4 | −640 | 0.9 | 3.5 |
| COMPARATIVE EXAMPLE 5 | −640 | 0.8 | 3.4 |

Further, the photosensitive members obtained in Examples 1–5, 11–15, 21–25, 31–35, 48, 52–56 and comparative Examples 1–5 were installed into a copying machine (EP-350Z; made by Minolta Camera K.K.) to be subjected to continuous repetition test of 3000 times of copy. Then, the photosensitive members were corona-charged at −6 KV power. A surface potential and a residual potential after irradiation of erasing light were measured respectively.

The results are shown in Table 9. It is understood that the properties of the photosensitive members are very stable.

TABLE 9

| | electron-attracting compound | hindered phenol | initial $V_0$ (V) | initial $V_R$ (V) | after 30000 times of copy $V_0'$ (V) | after 30000 times of copy $V_R'$ (V) |
|---|---|---|---|---|---|---|
| EXAMPLE 1 | [I-2] | | −650 | −10 | −650 | −20 |
| EXAMPLE 2 | [I-3] | — | −650 | −15 | −640 | −25 |
| EXAMPLE 3 | [I-4] | — | −650 | −10 | −640 | −25 |
| EXAMPLE 4 | [I-5] | — | −650 | −15 | −650 | −25 |
| EXAMPLE 5 | [I-9] | [2] | −650 | −10 | −650 | −15 |
| EXAMPLE 11 | [II-2] | | −650 | −10 | −650 | −20 |
| EXAMPLE 12 | [II-3] | — | −650 | −10 | −640 | −25 |
| EXAMPLE 13 | [II-4] | — | −650 | −15 | −640 | −25 |
| EXAMPLE 14 | [II-5] | — | −650 | −15 | −650 | −30 |
| EXAMPLE 15 | [II-8] | [2] | −650 | −10 | −650 | −15 |
| EXAMPLE 21 | [III-2] | | −650 | −10 | −640 | −20 |
| EXAMPLE 22 | [III-3] | — | −650 | −10 | −640 | −25 |
| EXAMPLE 23 | [III-4] | — | −650 | −15 | −650 | −25 |
| EXAMPLE 24 | [III-7] | — | −650 | −15 | −640 | −30 |
| EXAMPLE 25 | [III-9] | [2] | −650 | −10 | −650 | −15 |
| EXAMPLE 31 | [IV-1] | [2] | −650 | −10 | −650 | −30 |
| EXAMPLE 32 | [IV-2] | [5] | −650 | −15 | −660 | −35 |
| EXAMPLE 33 | [IV-3] | [15] | −650 | −10 | −640 | −35 |
| EXAMPLE 34 | [IV-7] | [17] | −650 | −10 | −660 | −30 |
| EXAMPLE 35 | [IV-8] | [20] | −650 | −15 | −650 | −35 |
| EXAMPLE 48 | [IV-19] | [5] | −660 | −10 | −650 | −25 |
| EXAMPLE 52 | [V-4] | [2] | −650 | −10 | −650 | −30 |
| EXAMPLE 53 | [V-6] | [5] | −650 | −15 | −660 | −35 |
| EXAMPLE 54 | [V-9] | [15] | −650 | −10 | −640 | −35 |
| EXAMPLE 55 | [V-10] | [17] | −650 | −10 | −660 | −30 |
| EXAMPLE 56 | [V-13] | [20] | −650 | −15 | −650 | −35 |
| COMPARATIVE EXAMPLE 1 | — | — | −650 | −20 | −720 | −110 |
| COMPARATIVE EXAMPLE 2 | — | [2] | −660 | −25 | −730 | −140 |
| COMPARATIVE EXAMPLE 3 | [A] | — | −640 | −10 | −390 | −5 |
| COMPARATIVE EXAMPLE 4 | [B] | — | −640 | −20 | −530 | −40 |
| COMPARATIVE EXAMPLE 5 | [C] | — | −640 | −15 | −580 | −60 |

What is claimed is:

1. A photosensitive member composed of a photosensitive layer on an electrically conductive substrate characterized by that the photosensitive layer comprises a charge generating material, a charge transporting material, a binder resin and an electronattracting compound represented by the following general formulas [I], [II], [III] or mixture thereof:

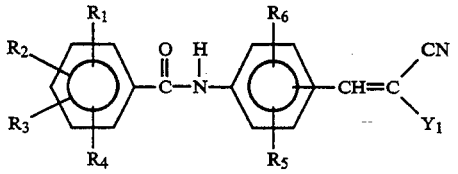

[I]

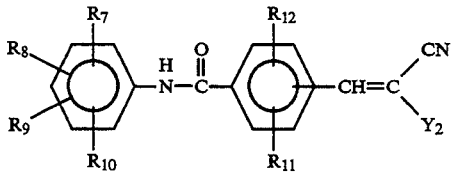

[II]

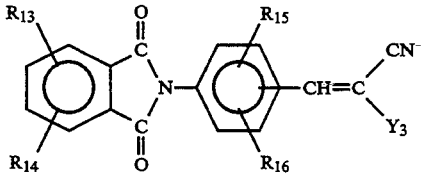

[III]

in which $Y_1$, $Y_2$ and $Y_3$ represent respectively a cyano group, an alkoxycarbonyl group, aryloxycarbonyl group which may have a substituent or an aryl group which may have a substituent;

$R_1$–$R_{16}$ represent respectively a hydrogen atom, a halogen atom, an alkyl group, an alkoxy group, a nitro group, a cyano group, a benzoyl group which may have a substituent, an aryloxycarbonyl group which may have a substituent, an alkoxycarbonyl or

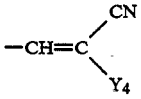

in which $Y_4$ represents a cyano group, an alkoxycarbonyl group, an aryloxycarbonyl group which may have a substituent, or an aryl group which may have a substituent.

2. A photosensitive member of claim 1, in which the charge transporting material is contained in the photosensitive layer at a content of 0.01–2 parts by weight on the basis of 1 part by weight of the binder resin.

3. A photosensitive member of claim 2, in which the electronattracting compounds are contained in the photosensitive layer at a content of 0.01–10% by weight on the basis of the charge transporting material.

4. A photosensitive member of claim 1, in which the photosensitive layer comprises a charge generating layer and a charge transporting layer.

5. A photosensitive member of claim 4, in which the charge transporting material is contained in the charge transporting layer at a content of 0.2–2 parts by weight on the basis of 1 part by weight of a binder resin.

6. A photosensitive member of claim 5, the electronattracting compound is contained in the charge transporting layer at a content of 0.01–10% by weight on the basis of the charge transporting material.

7. A photosensitive member composed of a photosensitive layer on an electrically conductive substrate characterized by that the photosensitive layer comprises a charge generating material, a charge transporting material, a binder resin, an electronattracting compound represented by the following general formulas [I], [II], [III], [IV] and/or [V], and a hindered phenol compound represented by the following general formulas [VI], [VII] and/or [VIII];

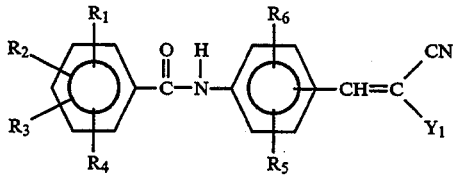
[I]

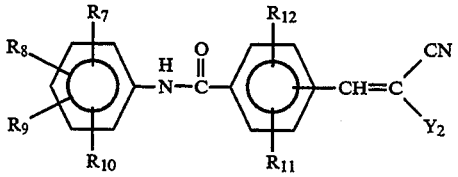
[II]

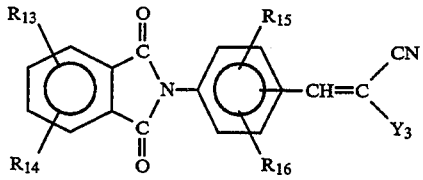
[III]

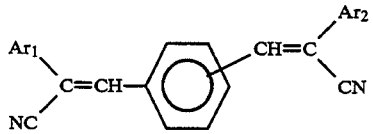
[IV]

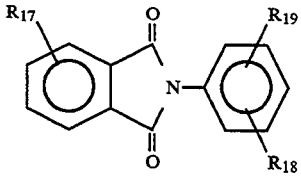
[V]

in which $Y_1$, $Y_2$ and $Y_3$ represent respectively a cyano group, an alkoxycarbonyl group, aryloxycarbonyl group which may have a substituent or an aryl group which may have a substituent;

$R_1$–$R_{16}$ represent respectively a hydrogen atom, a halogen atom, an alkyl group, an alkoxy group, a nitro group, a cyano group, a benzoyl group which may have a substituent, an aryloxycarbonyl group which may have a substituent, an alkoxycarbonyl or

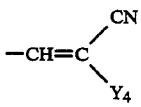

in which $Y_4$ represents a cyano group, an alkoxycarbonyl group, an aryloxycarbonyl group which may have a substituent;

$Ar_1$ and $Ar_2$ represent respectively a cyano group, an aryl group which may have a substituent, an alkoxycarbonyl group, an acyl group, an aminocarbonyl group, a halogen atom, an alkyl group or a benzoyl group which may have a substituent;

$R_{17}$ represent a hydrogen atom, a halogen atom, cyano group or a nitro group;

$R_{18}$ and $R_{19}$ represent respectively a hydrogen atom, a halogen atom, a cyano group, a nitro group, a carboxyl group, an acyl group, an acyloxyl group, an alkoxyalkyl group, —$SO_2R$ (R represents an alkyl group or an aryl group), an alkylcarbonyl group, an alkyl group, a benzyl group or an alkoxycarbonyl group;

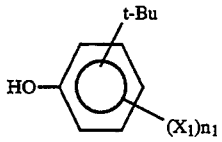
[VI]

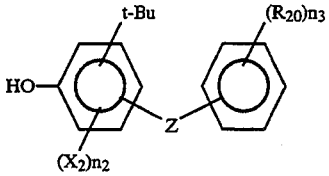
[VII]

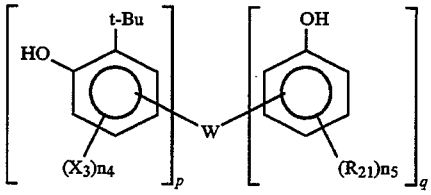
[VIII]

in which $X_1$–$X_3$ represent respectively a hydrogen atom, an alkyl group, an alkoxy group, a hydroxyl group, an aryl group or a heterocyclic group, each group of which may have a substituent;

$n_1$ represents an integer of 0–4; when $n_1$ is 2 or more, $X_1$ may be same of different;

$n_2$ represents an integer of 0–3; when $n_2$ is 2 or more, $X_2$ may be same of different;

$R_{20}$ and $R_{21}$ represent respectively a hydrogen atom, a hydroxyl group, an alkyl group, an alkoxy group, a carbonyloxy group, or an aralkyloxy group, or a heterocyclic group;

$n_3$ represents an integer of 0–5; when $n_3$ is 2 or more, $R_{20}$ may be same of different;

z represents —O—, —S—, —NH—, —$NR_{22}$—, —$CH_2$—$CHR_{23}$— ($R_{22}$ and $R_{23}$ represent respectively an alkyl group or an aryl group, each of which may have a substituent), an alkylene group, an arylene group, an aralkylene group, a bivalent group of alkane carboxylic acid, a bivalent group of alkyl ether;

$n_4$ represents an integer of 0–3; $n_5$ represents an integer of 0–4; when $n_4$ and $n_5$ is 2 or more, $X_3$ or $R_{21}$ may be same of different;

W represents a bivalent group of an alkyl carboxylate, a bivalent group of an alkyl carboxylate alkyl ether (including thioether), a bivalent group of aryloxycarbonylester, a bivalent group of heterocyclic ether, an aralkylene group, di(alkylcarbamoylalkyl), a bivalent group of arylcarboxylate and a bivalent group of hydrazide of carboxylic acid;

P, q represent respectively an integer of 1 or more; the total of p and q is 2–4.

8. A photosensitive member of claim 7, in which the charge transporting material is contained in the photosensitive layer at a content of 0.01–2 parts by weight on the basis of 1 part by weight of the binder resin.

9. A photosensitive member of claim 8, in which the electronattracting compound is contained in the photosensitive layer at a content of 0.01–10% by weight on the basis of the charge transporting material.

10. A photosensitive member of claim 7, the hindered phenol compound is contained in the photosensitive layer at a content of 1–30% by weight on the basis of the charge transporting material.

11. A photosensitive member of claim 10, the content of the hindered phenol compound is larger than that of the electronattracting compound.

12. A photosensitive member of claim 7, in which the photosensitive layer comprises a charge generating layer and a charge transporting layer.

13. A photosensitive member of claim 12, in which the charge transporting material is contained in the charge transporting layer at a content of 0.2–2 parts by weight on the basis of 1 part by weight of a binder resin.

14. A photosensitive member of claim 13, in which the electronattracting compound is contained in the charge transporting layer at a content of 0.01–10% by weight on the basis of the charge transporting material.

15. A photosensitive member of claim 14, in which the hindered phenol compound is contained in the charge transporting layer at a content of 1–30% by weight on the basis of the charge transporting material.

16. A photosensitive member of claim 15, in which the content of the hindered phenol compound is larger than that of the electronattracting compound.

* * * * *